US005692741A

United States Patent [19]

Nakamura et al.

[11] Patent Number: 5,692,741

[45] Date of Patent: Dec. 2, 1997

[54] METHOD AND APPARATUS FOR FEEDING SHEETS BASED ON COMPARISON OF ACTUAL TRAVEL TIME AND REFERENCE TRAVEL TIME

[75] Inventors: Hidenobu Nakamura, Toyokawa; Koji Naito, Toyohashi; Yoshiaki Nakajima, Toyokawa, all of Japan

[73] Assignee: Minolta Camera Kabushiki Kaisha, Osaka, Japan

[21] Appl. No.: 549,265

[22] Filed: Oct. 27, 1995

Related U.S. Application Data

[62] Division of Ser. No. 209,115, Mar. 9, 1994, Pat. No. 5,540,426.

[30] Foreign Application Priority Data

Mar. 10, 1993 [JP] Japan ..... 5-77570
Mar. 20, 1993 [JP] Japan ..... 5-85743

[51] Int. Cl.[6] ..... B65H 5/00

[52] U.S. Cl. ..... 271/10.03; 271/10.11; 271/258.01; 271/258.02; 271/265.01

[58] Field of Search ..... 271/258.01, 258.02, 271/258.03, 259, 265.01, 265.02, 10.03, 10.11, 10.12, 110, 114

[56] References Cited

U.S. PATENT DOCUMENTS

| | | | |
|---|---|---|---|
| 4,809,969 | 3/1989 | Bastow et al. | 271/258.03 |
| 4,868,609 | 9/1989 | Nagata | 355/316 |
| 5,112,038 | 5/1992 | Dunaway | 271/265.02 X |
| 5,379,994 | 1/1995 | Kushida | 271/265.01 X |
| 5,419,547 | 5/1995 | Jeong | 271/265.01 X |
| 5,423,527 | 6/1995 | Tranquilla | 271/259 X |

FOREIGN PATENT DOCUMENTS

| | | | |
|---|---|---|---|
| 51429 | 3/1986 | Japan | 271/270 |
| 46839 | 2/1987 | Japan | 271/259 |
| 62-136442 | 6/1987 | Japan . | |
| 158543 | 6/1990 | Japan | 271/265.01 |
| 2-144348 | 6/1990 | Japan | 271/270 |
| 2-204239 | 8/1990 | Japan . | |
| 2-282138 | 11/1990 | Japan | 271/270 |
| 2-42677 U | 11/1990 | Japan . | |
| 267241 | 11/1991 | Japan | 271/265.02 |
| 333453 | 11/1992 | Japan | 271/258.03 |
| 5-338845 | 12/1993 | Japan | 271/270 |
| 56309 | 3/1994 | Japan | 271/259 |
| 263283 | 9/1994 | Japan | 271/265.02 |

*Primary Examiner*—Boris Milef
*Attorney, Agent, or Firm*—Sidley & Austin

[57] ABSTRACT

In an operation for transporting a sheet by a first roller to a second roller pair downstream of the first roller, and further transporting the sheet by the second roller pair, the time during which the sheet is transported by the first roller is controlled, responsive to a comparison of a reference time and the actual time required for a sheet to be transported from the first roller to a predetermined position in the sheet transport path, to suppress disadvantages such as jamming and deformation into a Z-form, which may be caused by reduction of a transporting performance due to wear of the rollers and adhesion of paper powder to the rollers.

20 Claims, 24 Drawing Sheets

T1a: FEED ROLLER ON - FEED SENSOR ON

T2a: FEED ROLLER ON - OFF

METHOD AND APPARATUS FOR FEEDING SHEETS BASED ON COMPARISON OF ACTUAL TRAVEL TIME AND REFERENCE TRAVEL TIME

This application is a division of application Ser. No. 08/209,115, filed Mar. 9, 1994, now U.S. Pat. No. 5,540,426.

BACKGROUND OF THE INVENTION

1. Field of the Invention

The present invention relates to a method of feeding sheets and a device for the same which are used in image forming apparatuses such as copying machines and printing machines. In particular, the invention relates to a method and a device for correcting a state wherein paper sheets cannot be transported at an intended speed due to wear caused by aging of a roller for transporting the sheets and/or due to adhesion of paper powder onto a surface of the roller.

2. Description of the Related Art

In a sheet transporting system of an image forming apparatus such as a copying machine, sheets are transported by a plurality of rollers such as feed roller, transporting roller, intermediate roller, timing roller, transporting roller and discharge roller. For this sheet transporting system, there have been proposed a method and a device in which initiative in transporting a sheet is changed from a roller at an upstream position, in view of a moving direction of the sheet, to a subsequent roller pair, i.e., downstream roller pair next to the upstream roller, in accordance with a timing at which a leading edge of the sheet, which is being transported by a transporting force of the upstream roller, is pinched at a nip of the subsequent roller pair. In connection with such method and device, there has been proposed such a structure that a one-way clutch operates to idle the upstream roller after the change of initiative in transporting the sheets.

In the method and device for feeding sheets described above, however, the sheet cannot be transported by the downstream roller pair and thus stops, if the upstream roller is stopped before the leading edge of the sheet, which was being transported by the transporting force of the upstream roller, is pinched at the nip of the downstream roller pair. Thus, jamming of the sheet occurs. This situation, in which the upstream roller is stopped before the leading edge of the sheet is pinched at the nip of the downstream rollers, is caused, for example, by reduction of force for transporting the sheet due to the fact that slip is liable to generate because of wear caused by aging of the upstream roller and/or adhesion of paper powder.

Further, such a disadvantage may generate that the sheet slacks at a position between the upstream and downstream rollers and thereby bends, for example, into a Z-form, if the upstream roller, of which sheet transporting speed is relatively higher than that of the downstream roller, continuously applies the transporting force to the sheet even after the leading edge of the sheet is pinched at the nip of the downstream rollers and thereby the sheet starts to be transported by the transporting force of the downstream rollers. This situation, in which the upstream roller continuously applies the transporting force to the sheet even after the start of transportation of the sheet by the downstream rollers, is caused for example in the case where an excessively large margin for the transportation by the upstream roller is set in order to prevent the jamming. The situation, in which the transport speed of the downstream roller is lower than that of the upstream roller, is caused for example in such a case that slip is liable to occurs on the downstream roller due to wear caused by aging and/or due to adhesion of paper powder, which results in reduction of the sheet transporting ability of the downstream roller.

Even if the transport speed of the upstream roller reduces only to an extent that does not cause the serious problem described above, the sheet being transported may not reach a predetermined position (i.e., may not be detected at the predetermined position) within a predetermined time period, in which case the apparatus determines that jamming has occurred and thus stops its operation. Here, the above "predetermined time period" is a time period which is enough for the sheet, which is transported at a set speed, to reach a "predetermined position".

In view of the above, there has been proposed a method and a device for transporting sheets, in which drive, i.e., rotation of the feed roller is stopped in accordance with the timing at which a sensor opposed to a downstream roller pair detects that the leading edge of the sheet fed from the feed roller at the upstream position reaches the downstream roller pair.

These method and device can overcome the foregoing disadvantages. However, these method and device require a complicated structure for attaching the sensor. It is difficult to attach the sensor accurately to the nip portion of the downstream roller pair without a positional error.

SUMMARY OF THE INVENTION

Accordingly, it is a primary object of the invention to provide a method and a device for feeding sheets in which initiative in transporting a sheet changes from upstream transporting means to downstream transporting means in accordance with a timing at which a leading edge of the sheet is pinched by the downstream sheet transporting means, and particularly a method and a device which can suppress jamming and deformation into a Z-form of the sheet, which may be caused, for example, by wear of the transporting means due to aging and adhesion of paper powder, without requiring complicated mechanical structures relating to a position and a number of sensors and others.

The foregoing object of the invention can be achieved by the following method and device for transporting sheets.

(1) A method of transporting sheets in which the sheet is transported by a first roller to a second roller pair downstream of the first roller, and is further transported by the second roller pair, the method including the steps of detecting a transport speed of the sheet transported by the first roller to obtain a detected speed, and controlling a time period, for which the first roller is driven, in accordance with the detected speed: and a sheet transporting device including:

a first roller for transporting sheets;

first driver means for driving the first roller to rotate;

a second roller pair which is arranged downstream of the first roller for downwardly transporting the sheet transported from the first roller;

second driver means for driving the second roller pair to rotate;

speed detecting means for detecting a transport speed of the sheet transported by the first roller; and control means for controlling a drive time period, for which the driver means drives the first roller, based on the speed detected by the speed detecting means.

According to above method and device, the transport speed of the sheet transported by the roller may be larger than that by the second roller pair. The control means may be adapted to determine the drive time period of the first roller by adding to or subtracting from a reference time period a correction time period based on the reference time period and the detected speed. The above method and device may employ input means for entering maintenance information for the first roller, and correcting means for changing the correction time period toward zero when the maintenance information is entered. In the foregoing method and device, the above input means may be employed such that the control means operates to reset the drive time of the first roller to a predetermined reference time period according to an input from the input means.

(2) A method of transporting sheets in which the sheet is transported to a downstream second roller pair by a first roller, and is further transported by the second roller pair, the method including the steps of obtaining a speed difference between sheet transport speeds of the first roller and the second roller pair, and controlling a drive time for which the first roller is driven according to the speed difference: and a sheet transporting device including:

a first roller for transporting sheets;

first driver means for driving the first roller to rotate;

a second roller pair which is arranged downstream of the first roller for pinching the sheet transported from the first second roller at a nip of the roller pair and further transporting the sheet;

second driver means for driving the second roller pair to rotate;

a first speed sensor for detecting a transport speed of the sheet transported by the first roller;

a second speed sensor for detecting a transport speed of the sheet transported by the second roller pair;

arithmetic means for arithmetically obtaining a speed difference between the sheet transport speeds of the first roller and the second roller pair; and control means for controlling a drive time period, for which the first driver means drives the first roller, based on the speed difference calculated by the arithmetic means.

The foregoing method and device may employ input means for entering maintenance information for the first roller, and the control means may be adapted to reset the drive time period for the first roller to a predetermined reference time period according to an input sent from the input means.

(3) A method of feeding sheets in which the sheet being in contact with sheet transporting means is transported by driving the transporting means for a predetermined drive time period, including the steps of obtaining an actual travel distance which the sheet travels within the predetermined time period, comparing the thus obtained actual travel distance with a predetermined constant travel distance corresponding to the predetermined time period, and correcting the drive time period for the transporting means so as to change the actual travel distance toward the predetermined constant travel distance in accordance with a difference of said distances: and A device for feeding sheets including:

transporting means for transporting a sheet being in contact with the same;

drive means for driving the transporting means to rotate;

a timer for counting a time so as to operate the drive means for a predetermined time period;

arithmetic means for calculating a travel distance by which the sheet is travelled by driving the drive means for the predetermined time period; and correcting means for changing a count time of the timer so as to change the travel distance obtained from a result of calculation by the arithmetic means toward a constant travel distance which is predetermined in accordance with the predetermined time period.

In the foregoing method and device, the constant travel distance may be a distance from the first transporting means to downstream transporting means located next to the same. The sheet transport speed of the first transporting means may be larger than the sheet transport speed of the downstream transporting means. The first transporting means may be a roller such as a feed roller adapted to sequentially feed stacked sheets. The method and device may employ a sheet sensor located downstream of the first transporting means for detecting arrival of the sheet, and a second timer for measuring a time period from start of transportation of the sheet by the first transporting means to detection of the arrival of the sheet by the sheet sensor. In this case, the arithmetic means calculates a travel distance of the sheet based on a measured value of the second timer.

The foregoing method may be implemented by a sheet feeding device in which a feed roller being in contact with a sheet is rotated to transport the sheet by a predetermined distance, and which includes;

a timer which allows rotation of the feed roller when turned on;

arithmetic means which calculates a shortage of a distance, by which the sheet is travelled by rotation of the feed roller for a predetermined time period set by the timer, with respect to a predetermined distance corresponding to the predetermined time period; and a controller for changing a timer value to extend a time period, during which the timer is in the on state, in accordance with the shortage of the distance calculated by the arithmetic means.

(4) A method of transporting sheets in which a sheet feed roller is driven to transport the sheet being in contact with the same for a predetermined time period, including the steps of counting a number of the sheets transported by the roller, and extending the predetermined time period to a second predetermined time period when a count exceeds a predetermined value: and A sheet feeding device including:

a roller for transporting a sheet being in contact with the same;

drive means for driving the roller to rotate;

a timer for restricting a drive time period for the drive means to a predetermined time period;

a counter for counting a number of sheets transported by the roller; and control means for controlling the predetermined time period of the timer to extend the same to a second predetermined time period when a count of the counter exceeds a predetermined value.

The roller may be a feed roller for sequentially feeding stacked sheets. The device may employ second transporting means located downstream of and next to the roller, and the time period restricted by the timer may be substantially equal to a transport time period from start of transportation of the sheet by the roller to arrival of the sheet at the second transporting means.

(5) A method of feeding sheets in which the sheet being in contact with sheet transporting means is transported by driving the means, including the steps of measuring a time period from start of drive of the transporting means, determining a state as jamming when a sheet sensor, which is disposed downstream of and spaced by a predetermined distance from the transporting means, does not detect the sheet before the measured time period exceeds a predetermined time period, and correcting the predetermined time period into a larger value, which enables appropriate determination of the jamming, in accordance with a shortage of distance from a distance by which the sheet is to be travelled within the predetermined time period: and A sheet feeding device including:

a roller which is rotated for a predetermined time period to transport a sheet by a distance corresponding to a quantity of rotation of the roller;

sheet detecting means disposed downstream the roller and spaced therefrom by a predetermined distance;

time measuring means for measuring an elapsed time after a time of start of sheet transportation by the roller;

determining means for determining a state as jamming if the sheet detecting means does not detect the sheet before the predetermined period elapses after the time of start of the sheet transportation by the roller;

arithmetic means for calculating an extent by which a travel distance of the sheet transported by the rotation of the roller for a predetermined time period is shorter than a predetermined constant distance corresponding to the predetermined time period; and correcting means for correcting the predetermined time period utilized by the determining means into an appropriate value based on a result of calculation of the arithmetic means.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

A practical example of a method and a device for feeding sheets according to the invention will be described below with reference to FIGS. 1 to 13. The sheet feeding method described below is implemented by a sheet feeding device in a first copying machine shown in FIG. 1.

[1] STRUCTURES OF FIRST COPYING MACHINE

Description will first be made on structures of the copying machine equipped with the sheet feeding device.

Figure 1:
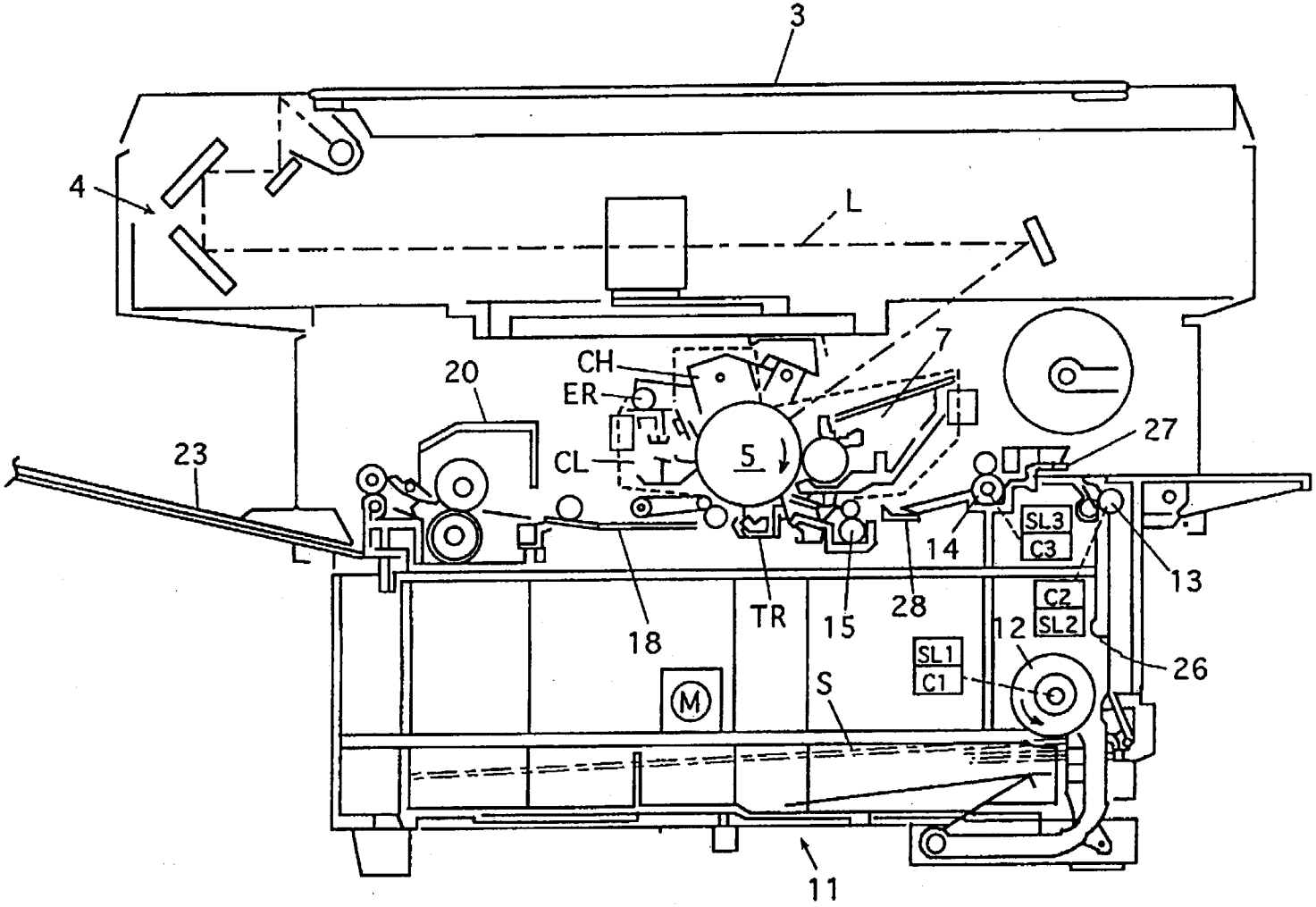
FIG. 1 schematically shows an internal mechanism of a first copying machine.
Figure 2:
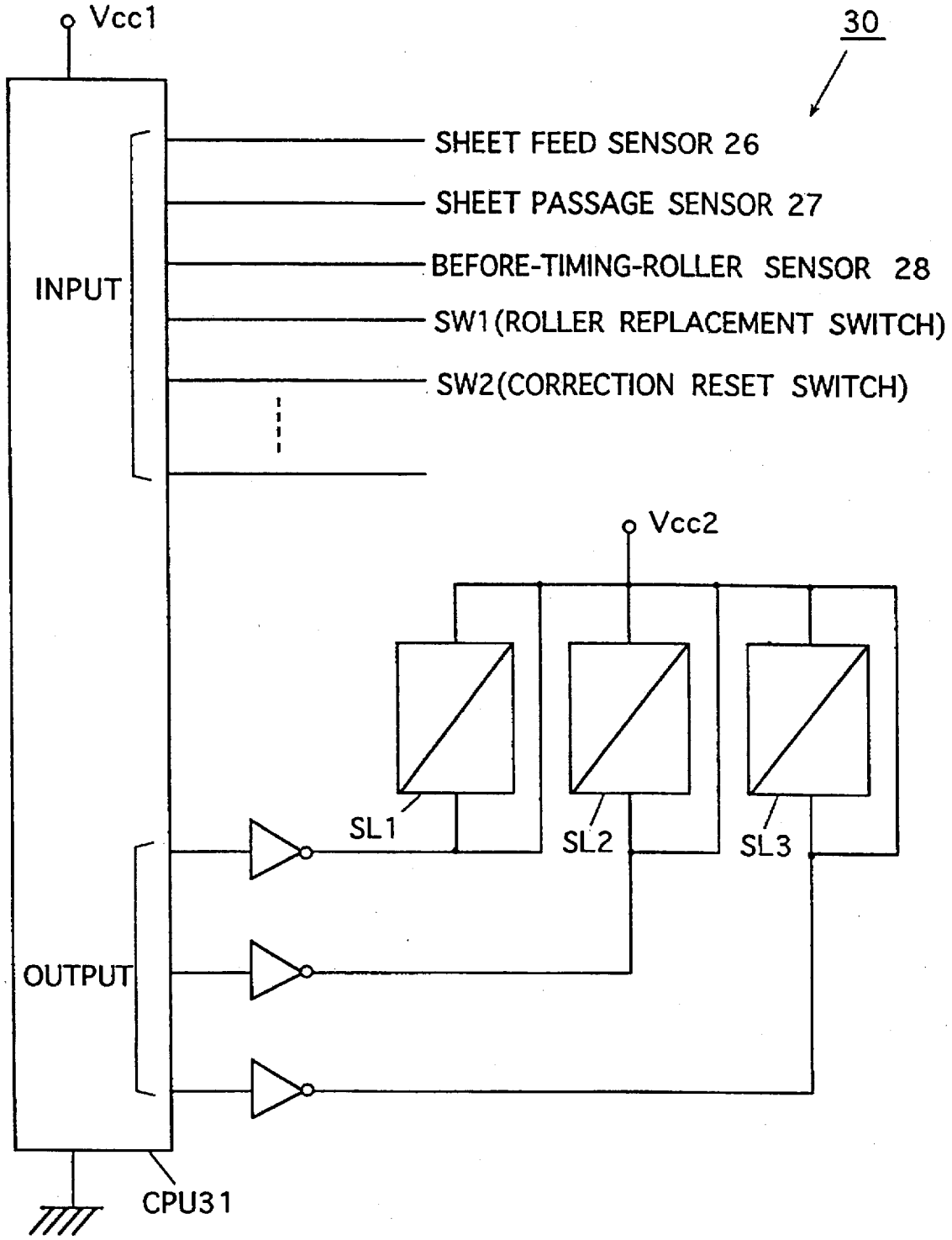
FIG. 2 is a block diagram showing a portion of a control circuitry in the first copying machine.

FIG. 1 schematically shows a mechanism of the copying machine, and FIG. 2 shows signals, which are used for transportation of sheets, sent to and from a central part CPU31 of a controller 30 in the copying machine. The central part CPU31 comprises a microcomputer as a major component which includes a center processing unit, a read only memory (ROM) and a random access memory (RAM).

The illustrated copying machine performs an electrophotographic image formation. More specifically, an original set on a glass plate 3 is exposed and scanned by a scanning optical system 4. Thereby, reflected light L in a slit form reflected by the original forms an image on a surface of a photosensitive drum 5 which has been electrically and uniformly charged by a charger CH, so that an electrostatic latent image corresponding the reflected light L is formed on the surface of the drum 5. The latent image is developed with toner by a developing device 7 into a visible image, which is transferred by a transferring device TR onto a sheet. The sheet bearing the image transferred onto the same is transported along a transport guide plate 18 to a fixing device 20, and the image fixing processing is effected by thermal compression bonding. Thereafter, the sheet is discharged to an external tray 23. Toner remaining on the drum after the transference is removed by a cleaning device CL, and residual electric charges are erased by an eraser ER.

The sheets S are accommodated in and are fed from a sheet cassette 11 which is removably provided at a lower portion of the machine. A feed roller 12 confronting the cassette 11 is coupled to a drive system including an electric motor M via a clutch C1. The clutch C1 includes a portion which is selectively engaged with and disengaged from the driving system in accordance with turning on and off of a solenoid SL1, and a one-way clutch portion. When the solenoid SL1 is turned on, it transmits a power of the driving system to the feed roller 12 to rotate the same. When the solenoid SL1 is turned off, the power is interrupted, so that the roller 12 can freely rotate in a sheet feeding direction.

Above the feed roller 12 and along a sheet transporting path to a transferring position, there are sequentially disposed a sheet feed sensor 26, a transporting roller pair 13, a sheet passage sensor 27, an intermediate roller pair 14, a before-timing-roller sensor 28 and a timing roller pair 15. The transporting roller pair 13 has rollers, one of which is coupled to the driving system described above via a clutch C2, which has the same structure as the clutch C1 and is operated by a solenoid SL2. The intermediate roller pair 14 has rollers, one of which is coupled to the driving system described above via a clutch C3, which has the same structure as the clutch C1 and is operated by a solenoid SL3. The solenoids SL1, SL2 and SL3 are turned on and off based on instructions sent from the CPU 31.

The sheets S accommodated in the sheet cassette 11, which is removably disposed at the lower portion of the machine, are fed from the sheet cassette 11 as will be described later, and are transported to the transferring position, i.e., the position at which the toner image on the photosensitive drum 5 is transferred onto the sheet, at a predetermined timing synchronized with a forward end of the image on the photosensitive drum 5.

First, the solenoid SL1 (FIG. 2) is turned on in response to a signal sent from the CPU 31, and thereby the feed roller 12 starts to rotate. The feed roller 12 which rotates counterclockwise in the figure repetitively feeds the uppermost sheet S in the sheet cassette 11. Then, the fed sheet S is transported upwardly in the figure to the transporting roller pair 13, and then is turned and fed leftwardly by the transporting roller pair 13 which is driven owing to turned-on state of the solenoid SL2.

After the initiative in transporting the sheet changes from the feed roller 12 to the transporting roller pair 13, the solenoid SL1 is turned off, and the feed roller 12 is not driven by the drive system. Thus, the one-way clutch allows free rotation of the roller 12.

The sheet fed leftwardly by the transporting roller pair 13 reaches the intermediate roller pair 14, and then is further transported by the intermediate roller pair 14 which rotates in response to turned-on state of the solenoid SL3. When the leading edge of the sheet reaches the timing roller pair 15, the sheet is temporarily stopped there, and then will be fed to the transferring position by the timing roller pair 15 at the predetermined timing described before. After the initiative in transporting the sheet changes from the transporting roller pair 13 to the intermediate roller pair 14, the solenoid SL2 is turned off, so that the transporting roller pair 13 is not driven by the drive system. Thus, the one-way clutch allows free rotation of the transporting roller pair 13.

The sheet feed sensor 26, which is disposed immediately downstream the feed roller 12, detects the sheet fed from the sheet cassette 11 by the feed roller 12. The passage sensor 27, which is disposed between the transporting roller pair 13 and the intermediate roller pair 14, detects the sheet which passed the transporting roller pair 13. The before-timing-roller sensor 28, which is disposed immediately upstream the timing roller pair 15, detects the sheet which passed the intermediate roller pair 14 and reached a position immediately before the timing roller 15. Detection signals from these sensors are sent to the CPU 31.

The CPU 31 also receives signals from a roller replacement switch SW1 and a correction reset switch SW2. The roller replacement switch SW1 is actuated, e.g., by a service man who replaced the roller(s) with new one(s). The correction reset switch SW2 is actuated, e.g., by the service man who carried out maintenance. In response to these input signals, the CPU 31 controls the solenoids SL1–SL3 to turn on and off as represented by flowcharts which will be described later, whereby the sheets are fed and transported under optimum control.

[2] CONTROL OF SHEETS IN FIRST COPYING MACHINE

Then, referring to FIGS. 12 and 13, control of operations for feeding and transporting the sheets will be described below with reference to flowcharts shown in FIGS. 3 to 11.

Figure 3:
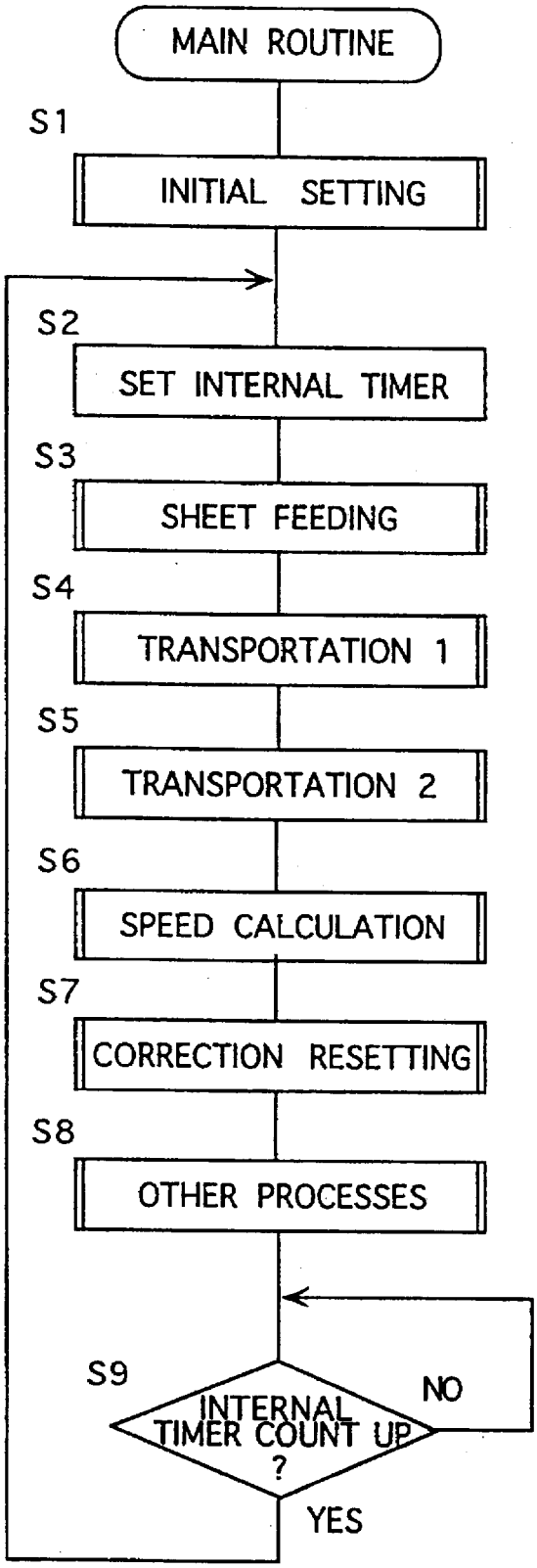
FIG. 3 is a flowchart showing a main routine of processes in a CPU 31 in FIG. 2.

[2-1] Main Routine (See FIG. 3)

The CPU 31 contains a control program shown in FIG. 3.

Upon turn-on of the power, initial setting is first carried out (S1). At a subsequent step S2, an internal timer for setting a cycle time of the control program is set and starts, and then, respective processes at steps S3–S8, which will be described later, are repetitively carried out after every elapsing of the set time of the internal timer (S9). The step S8 totally represents processes other than the processes at the steps S3–S7 carried out by the CPU 31. The processes at the step S8 do not directly concern the instant invention, and thus will not be described below.

[2-2] Description of Timers and Flags

Prior to description of the steps S3–S7, functions of timers T0–T6 and flags 1–7 used in the respective processes will be described below.

* Timer T0

The timer T0 controls the timing for turning off the solenoid SL1, i.e., timing for stopping the driving of the feed roller 12. At a time point of start of the copying operation (i.e., start of rotation of the feed roller 12), the timer T0 starts counting, and the solenoid SL1 is turned off to stop driving of the feed roller 12 in response to the count-up thereof. The time set in the timer T0 is enough to allow the leading edge of the sheet fed by the feed roller 12 to be pinched at the nip of the transporting roller pair 13. A margin of, e.g., about 30 mm may be set.

* Timer T1

The timer T1 controls the timing for turning on the solenoid SL2, i.e., timing for starting the rotation of the transporting roller pair 13. When the leading edge of the sheet passes the sheet feed sensor 26, the timer T1 starts counting, and the solenoid SL2 is turned on to start rotation of the transporting roller pair 13 in response to the count-up thereof.

* Timer T2

The timer T2 controls the timing for turning off the solenoid SL2, i.e., timing for stopping the driving of the transporting roller pair 13. In response to the count-up of the timer T1 (i.e., start of rotation of the transporting roller pair 13), the timer T2 starts counting, and the solenoid SL2 is turned off to stop driving of the transporting roller pair 13 in response to the count-up thereof. A set value (initial value) T20 of the timer T2 is initially set to a value enough to allow such an action that the leading edge of the sheet transported by the transporting roller pair 13 is pinched at the nip of the intermediate roller pair 14 if neither wear of the transporting roller pair 13 nor adhesion of paper power thereto take place. A margin of, e.g., about 30 mm may be set.

* Timer T3

The timer T3 counts the time from the time point of turn-on of the solenoid SL2 (i.e., time point of start of rotation of the transporting roller pair 13) to the time point at which the leading edge of the sheet is detected by the passage sensor 27. Based on the count, i.e., result of the counting, a transport speed S0 of the sheet transported by the transporting roller pair 13 is arithmetically operated or calculated.

* Timer T4

The timer T4 controls the timing for turning on the solenoid SL3, i.e., timing for starting the rotation of the intermediate roller pair 14. When the leading edge of the sheet passes the passage sensor 27, the timer T4 starts counting, and the solenoid SL3 is turned on to start rotation of the intermediate roller pair 14 in response to the count-up thereof.

* Timer T5

The timer T5 controls the timing for turning off the solenoid SL3, i.e., timing for stopping the driving of the intermediate roller pair 14 in response to the count-up thereof. At a time of count-up of the timer T4 (i.e., start of rotation of the intermediate roller pair 14), the timer T5 starts counting, and the solenoid SL3 is turned off to stop driving of the intermediate roller pair 14 in response to the count-up thereof. A set time of the timer T5 is enough to allow such an action that the leading edge of the sheet transported by the intermediate roller pair 14 is pinched at the nip of the timing roller pair 15.

* Timer T6

The timer T6 counts the time from the time point of turn-on of the solenoid SL3 (i.e., start of rotation of the intermediate roller pair 14) to the time point at which the leading edge of the sheet is detected by the before-timing-roller sensor 28. Based on the count, i.e., result of the counting, a transport speed S1 of the sheet transported by the intermediate roller pair 14 is calculated.

* Flag 1

The flag 1 is used for detecting an on-edge of the feed sensor 26. On-edge means, in this specification, change of the state of the detection signal from the off-state to the on-state and, in this case, corresponds to the time at which the leading edge of the sheet passes the feed sensor 26. Thus, the on-edge of the feed sensor 26 is found when the flag 1 is 1 and the feed sensor 26 is turned on.

* Flag 2

The flag 2 is used to control the count of the timer T3. While the flag 2 is 1, the timer T3 performs the counting.

* Flag 3

This flag 3 is used for detecting the on-edge of the passage sensor 27 (in this case, the time at which the leading edge of the sheet passes the passage sensor 27). Thus, the on-edge of the passage sensor 27 is found if the flag 3 is 1 and the passage sensor 27 is turned on.

* Flag 4

This flag 4 is used for detecting the on-edge of the before-timing-roller sensor 28 (in this case, the time at which the leading edge of the sheet passes the before-timing-roller sensor 28). Thus, the on-edge of the before-timing-roller sensor 28 is found when the flag 4 is 1 and the before-timing-roller sensor 28 is turned on.

* Flag 5

This flag 5 is used to enable correction of the timer T2.

* Flag 6

This flag 6 is used to enable the calculation of speed.

* Flag 7

This flag 7 is used for controlling the counting operation of the timer T6. While the flag 7 is 1, the timer T6 performs the counting operation.

Now, the respective operations and processes will be described below.

Figure 4:
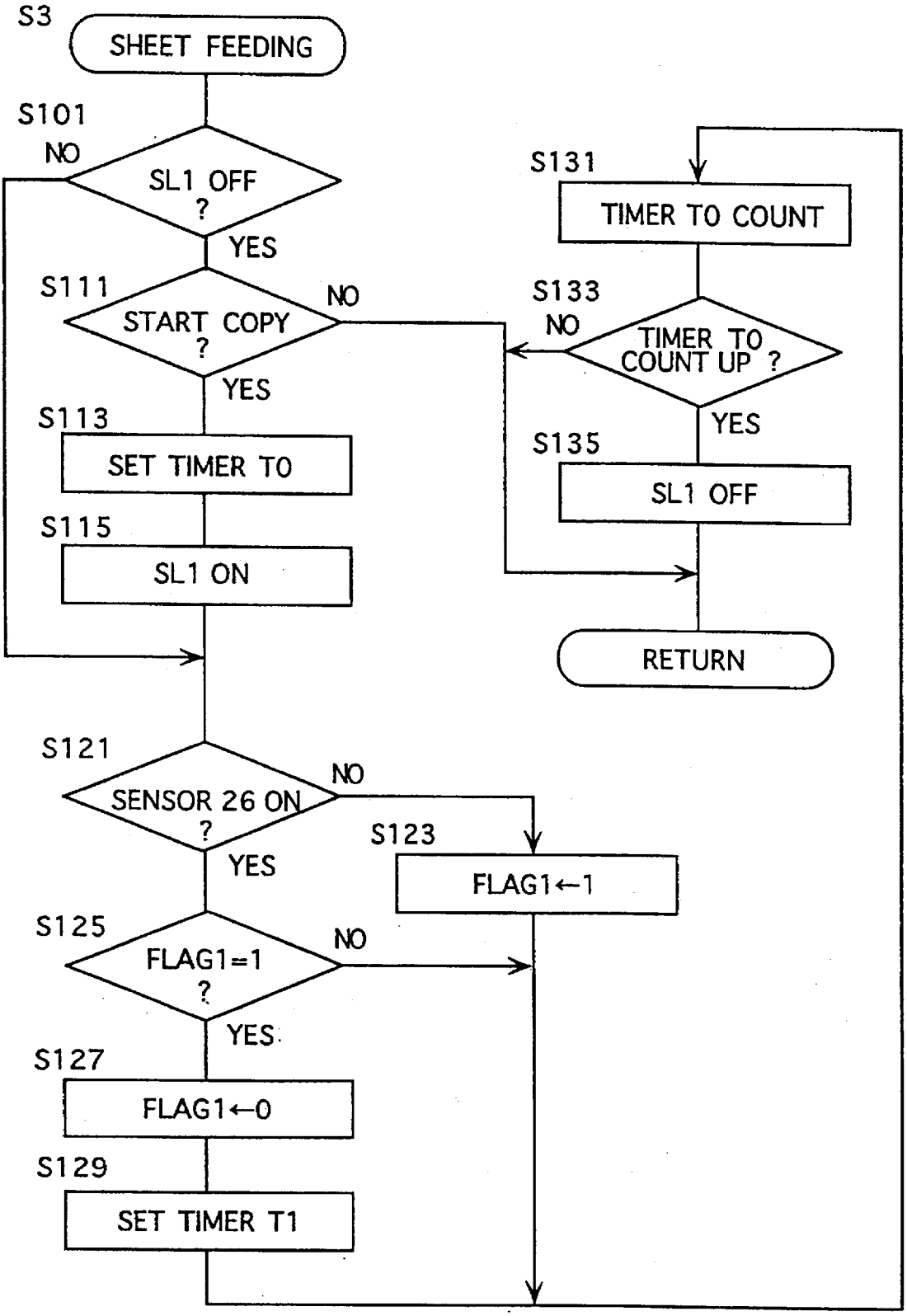
FIG. 4 is a flowchart showing a process at step S3 shown in FIG. 3.

[2-3] Sheet Feeding Operation (see FIG. 4)

Rotation and stop of the feed roller 12 are controlled.

While the solenoid SL1 is in the off state (S101: YES), a copy start instruction is issued (S111: YES), so that the timer T0 is set (S113) and the solenoid SL1 is turned on (S115). Thereby, the feed roller 12 starts the rotation, and continues the rotation during the counting period (S133) of the timer T0.

The flag 1 is held at 1 (S123) while the feed sensor 26 immediately after the feed roller 12 is in the off state (S121: NO), and is set to 0 (S127) when the leading edge of the fed sheet turns on the feed sensor 26 (S121: YES, and S125: YES). At this timing, the timer T1 is set to start the counting (S129).

At step S131, the timer T0 carries out the counting. Thus, the timer T0 carries out the counting every time the sheet feed operation (S3) is executed during rotation of the feed roller 12. In response to the count-up of the timer T0 (S133: YES), the solenoid SL1 is turned off (S135) to stop driving of the feed roller 12.

Figure 5:
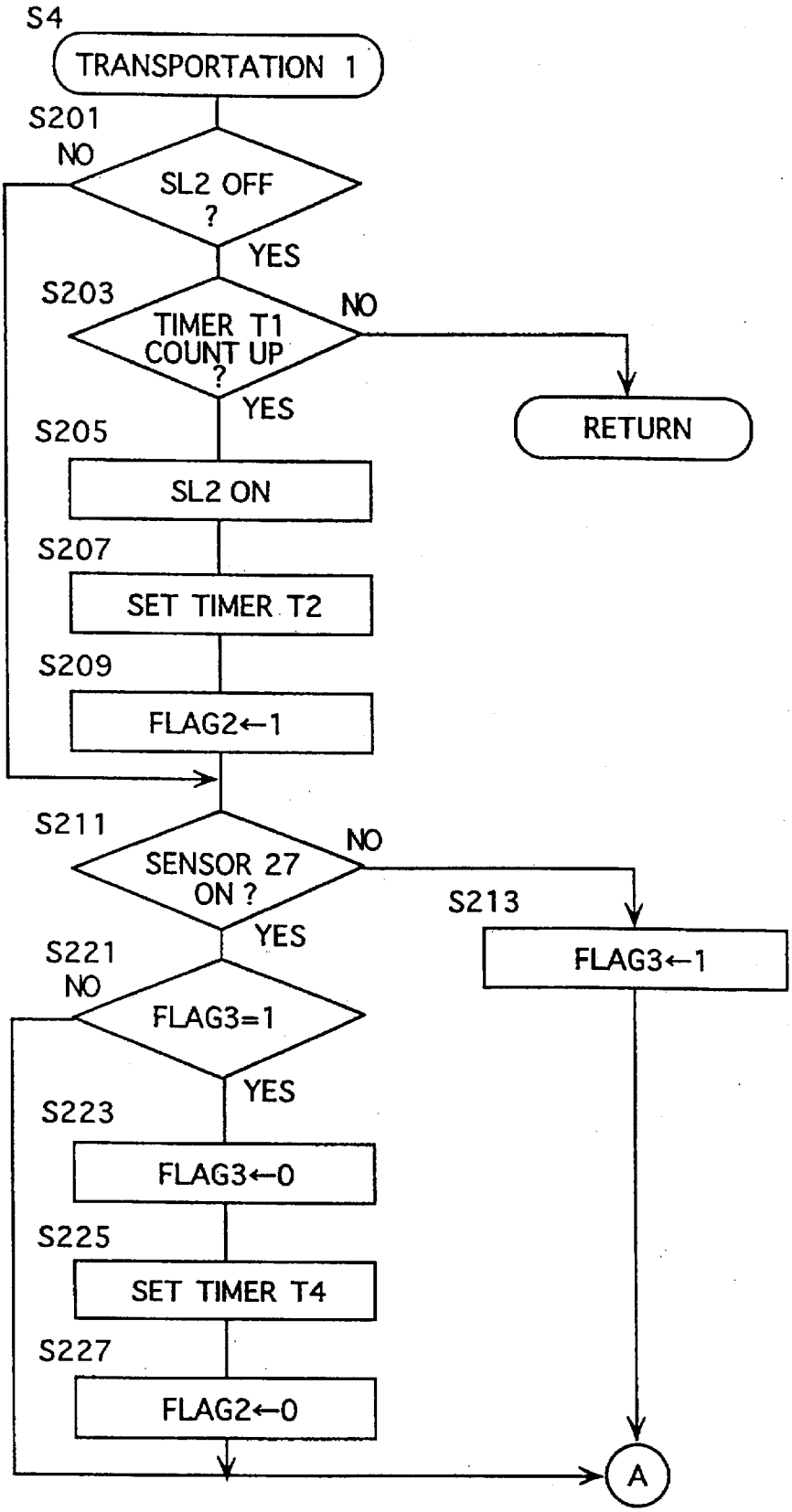
FIG. 5 is a flowchart showing a portion of a process at step S4 shown in FIG. 3.
Figure 6:
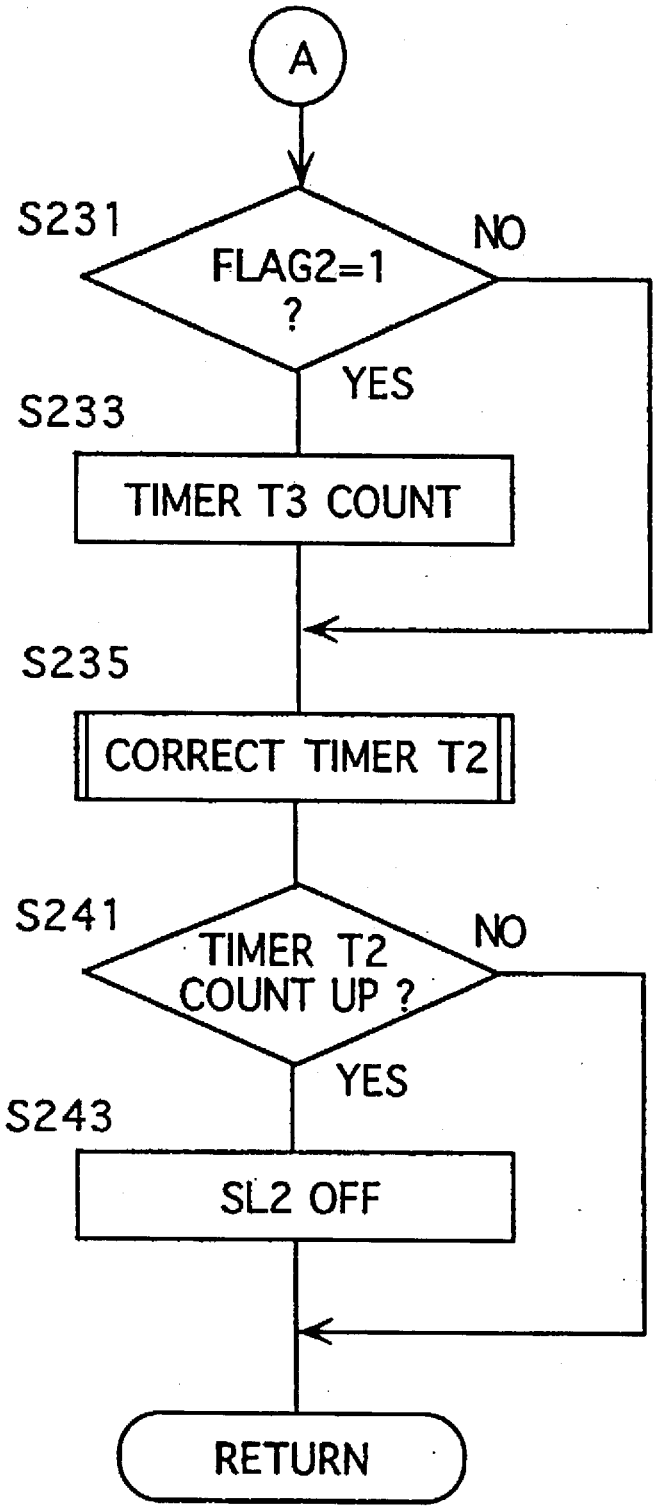
FIG. 6 is a flowchart showing a remaining portion of the process at step S4 in FIG. 3.

[2-4] Transporting Operation 1 (see FIGS. 5 and 6)

Rotation and stop of the transporting roller pair 13 are controlled.

When the timer T1 carried out the count-up (S203: YES) while the solenoid SL2 is in the off state (S201: YES), the solenoid SL2 is turned on to start rotation of the transporting roller pair 13 (S205). Also, at this timing, the timer T2 is set (S207), and the flag 2 is set to 1 (S209).

The flag 3, which is kept at 1 (S213) in response to the off state of the passage sensor 27 upstream of the intermediate roller pair 14 (S211: NO), is set to 0 (S223) when the passage sensor 27 is turned on by the leading edge of the sheet being transported (S211: YES, and S221: YES). At this timing, the timer T4 is set (S225), and further the flag 2 is set to 0 (S227). Thus, the flag 2 is kept at 1 after start of rotation of the transporting roller pair 13 to arrival of the leading edge of the sheet at the passage sensor 27. During this (S231: YES), the timer T3 carried out the counting every time the transporting operation 1 (S4) is executed.

At step S235, the timer T2 is corrected in a manner which will be specifically described later with reference to FIG. 9.

When the timer T2 carries out the count-up (S241: YES), which timer T2 carries out the counting in response to every transporting operation 1 (S4) during rotation of the transporting roller pair 13, the solenoid SL2 is turned off to stop the operation for driving the transporting roller pair 13.

Figure 7:
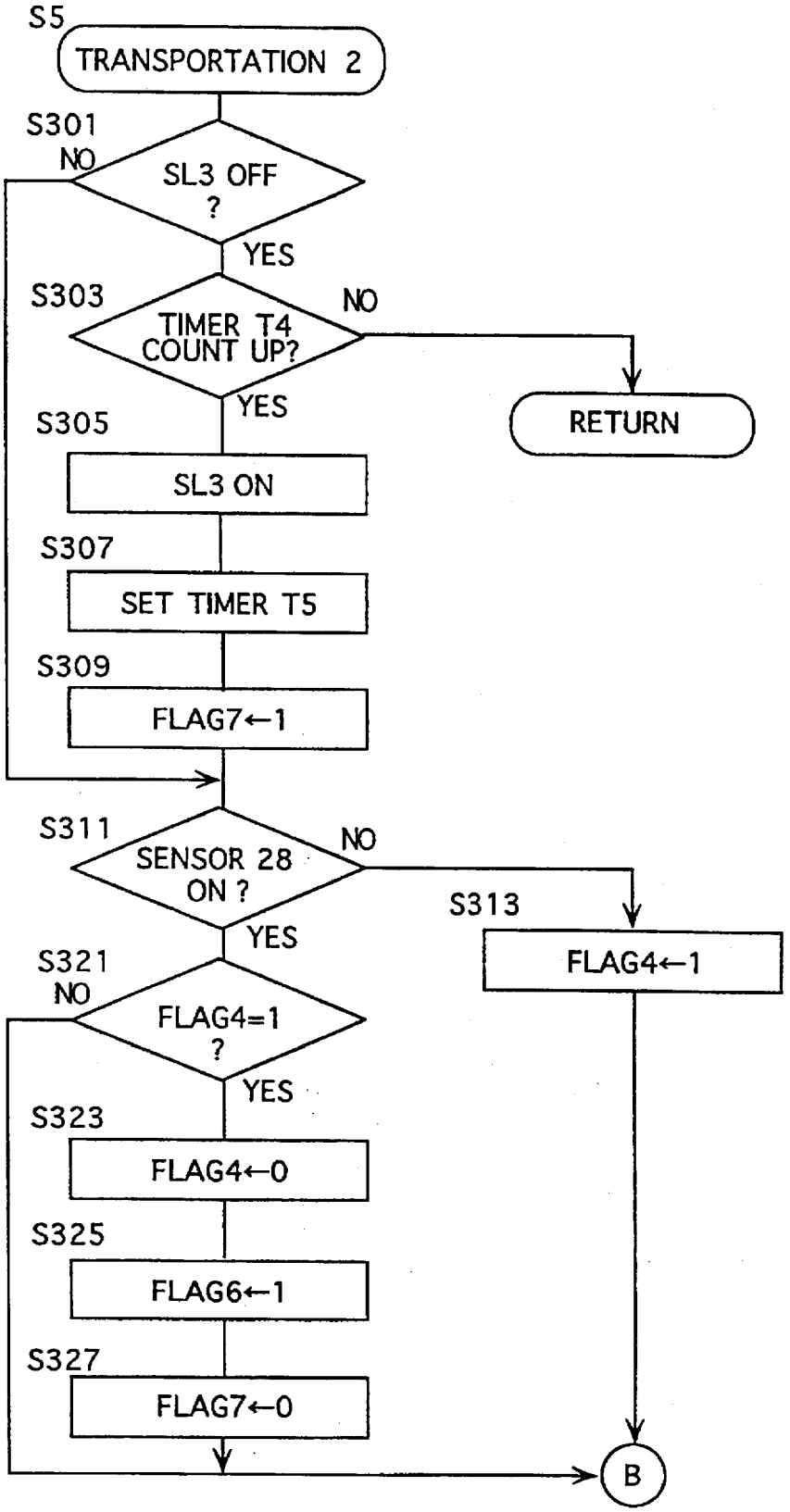
FIG. 7 is a flowchart showing a portion of a process at step S5 shown in FIG. 3.
Figure 8:
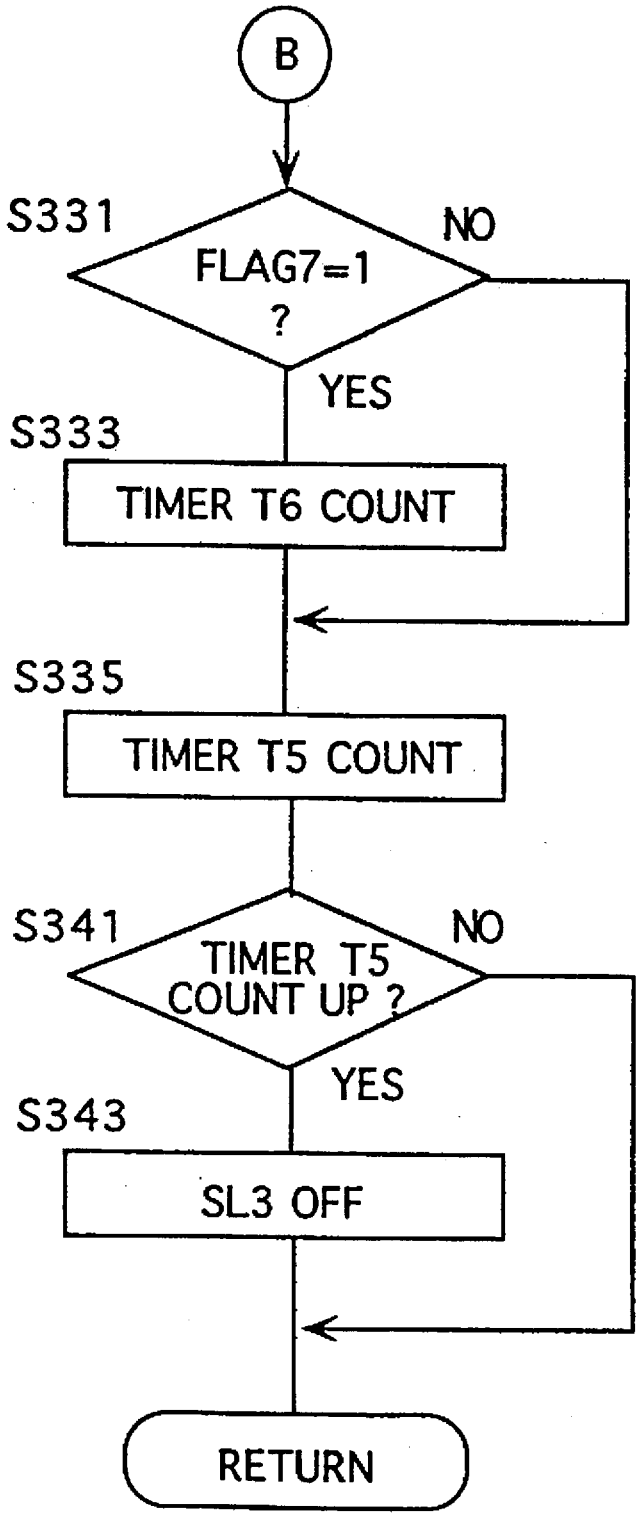
FIG. 8 is a flowchart showing a remaining portion of the process at step S5 in FIG. 3.

[2-5] Transporting Operation 2 (see FIGS. 7 and 8)

Rotation and stop of the intermediate roller pair 14 are controlled.

When the timer T4 carried out the count-up (S303: YES) while the solenoid SL3 is in the off state (S301: YES), the solenoid SL3 is turned on to start rotation of the intermediate roller pair 14 (S305). At this timing, the timer T5 is set (S307), and further the flag 7 is set to 1 (S309).

The flag 4 is kept at 1 (S313) while the before-timing-roller sensor 28 located immediately before the timing roller pair 15 is in the off state (S311: NO), and is set to 0 (S323) when the before-timing-roller sensor 28 is turned on (S311: YES, and S321: YES) by the leading edge of the sheet being transported. At this timing, the flag 6 is set to 1 (S325). Further, the flag 7 is set to 0 (S327). Thus, the flag 7 is kept at 1 after the start of rotation of the intermediate roller pair 14 and before arrival of the leading edge of the sheet at the before-timing-roller sensor 28. During this (S331: YES), the timer T6 carries out the counting (S333) every time the transporting operation 2 (S5) is executed.

At step S335, the timer T5 carries out the counting. Thus, the timer T5 carries out the counting (S335) every time the transporting operation 2 (S5) is executed during rotation of the intermediate roller pair 14. In response to the count-up of the timer T5 (S341: YES), the solenoid SL3 is turned off (S343) to stop the operation for driving the intermediate roller pair 14.

Figure 10:
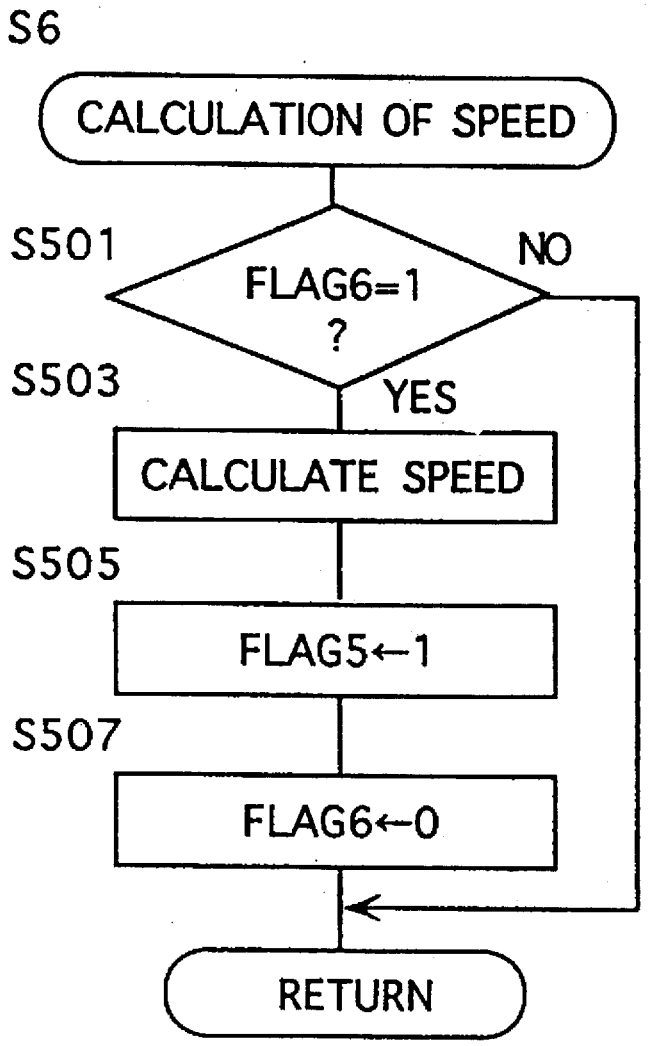
FIG. 10 is a flowchart showing a process at step S6 shown in FIG. 3.

[2-6] Speed Calculating Process (see FIG. 10)

The speed calculation is carried out (S503) when the before-timing-roller sensor 28 detects the leading edge of the sheet and thereby the flag 6 is set to 1 (S501: YES, see S325).

Figure 13:
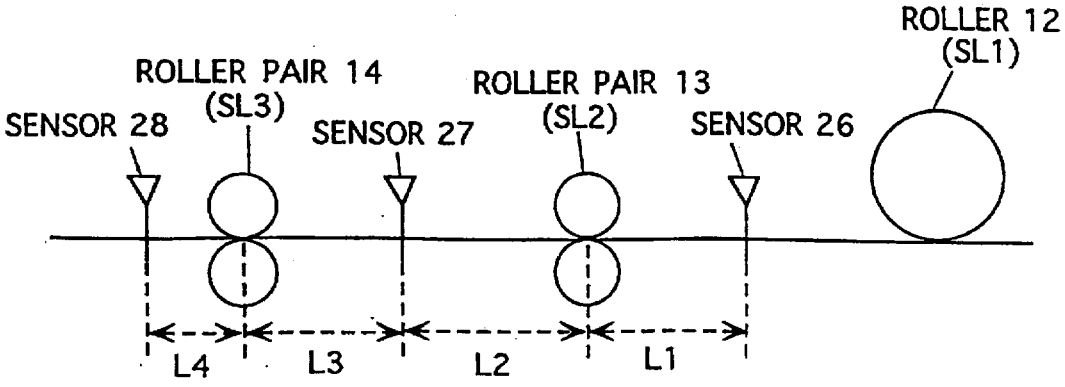
FIG. 13 schematically shows arrangement of rollers 12–14 and sensors 26–28 in the copying machine.

Assuming that the transporting roller pair 13 transports the sheet at the actual speed S0, the following relationship is obtained:

$$S0=L2/t3$$

where L2 is a distance between the transporting roller pair 13 and the passage sensor 27 shown in FIG. 13, and t3 is a time measured by the timer T3.

The actual speed S1 of the sheet transported by the intermediate roller pair 14 is calculated as follows:

$$S1=L4/t6$$

where L4 is a distance between the intermediate roller pair 14 and the before-timing-roller sensor 28 shown in FIG. 13, and t6 is a time measured by the timer T6.

After calculation of the speed, the flag 5 is set to 1 (S505), and the flag 6 is set to 0 (S507).

Figure 9:
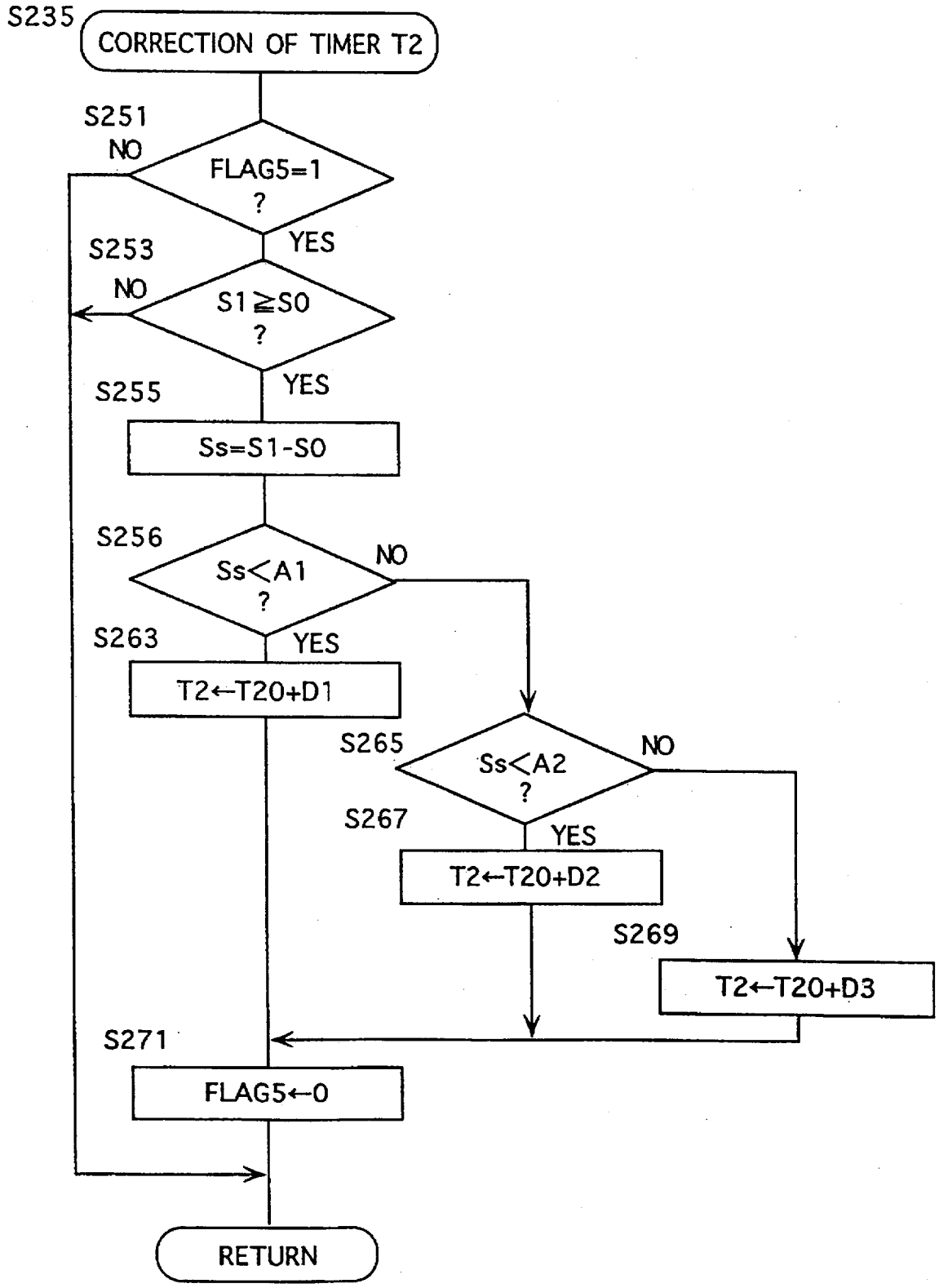
FIG. 9 is a flowchart showing a process at step S235 shown in FIG. 6.

[2-7] Correction of Timer T2 (see FIG. 9)

When the flag 5 is set to 1 (see S505), correction of the timer T2 is enabled (S251). First, the transport speed S1 of the sheet by the intermediate roller pair 14 is compared with the transport speed S0 of the sheet by the transporting roller pair 13 (S253).

In the case (S253: YES) of $$S1 \geqq S0$$

i.e., the transport speed S0 of the sheet transported by the transporting roller pair 13 is relatively small, a speed difference S1–S0 is substituted for $S_s$ (S255).

The speed difference $S_s$ is compared with predetermined values A1 and A2.

If $S_s$<A1 (S256: YES), a correction D1 is added to the initial value T20 of the timer T2, and the sum is substituted for the value of the timer T2 (S263).

If A1≦$S_s$<A2 (S265: YES), a correction D2 is added to the initial value T20 of the timer T2, and the sum is substituted for the value of the timer T2 (S267).

Similarly, if A2≦$S_s$ (S265: NO), a correction D3 is added to the initial value T20 of the timer T2, and the sum is substituted for the value of the timer T2 (S269).

The flag 5 is set to 0 after the correction (S271).

The foregoing values A1 and A2 as well as D1, D2 and D3 are prepared in advance for stepwise setting of the correction of the timer T2. For example, A1 and A2 are values set by measuring, e.g., through an experiment, a relationship between momentum of the roller pair and wear due to aging. D1, D2 and D3 are values which can compensate for deterioration of the transporting performance of the roller pair and are determined stepwise, e.g., through an experiment.

Figure 11:
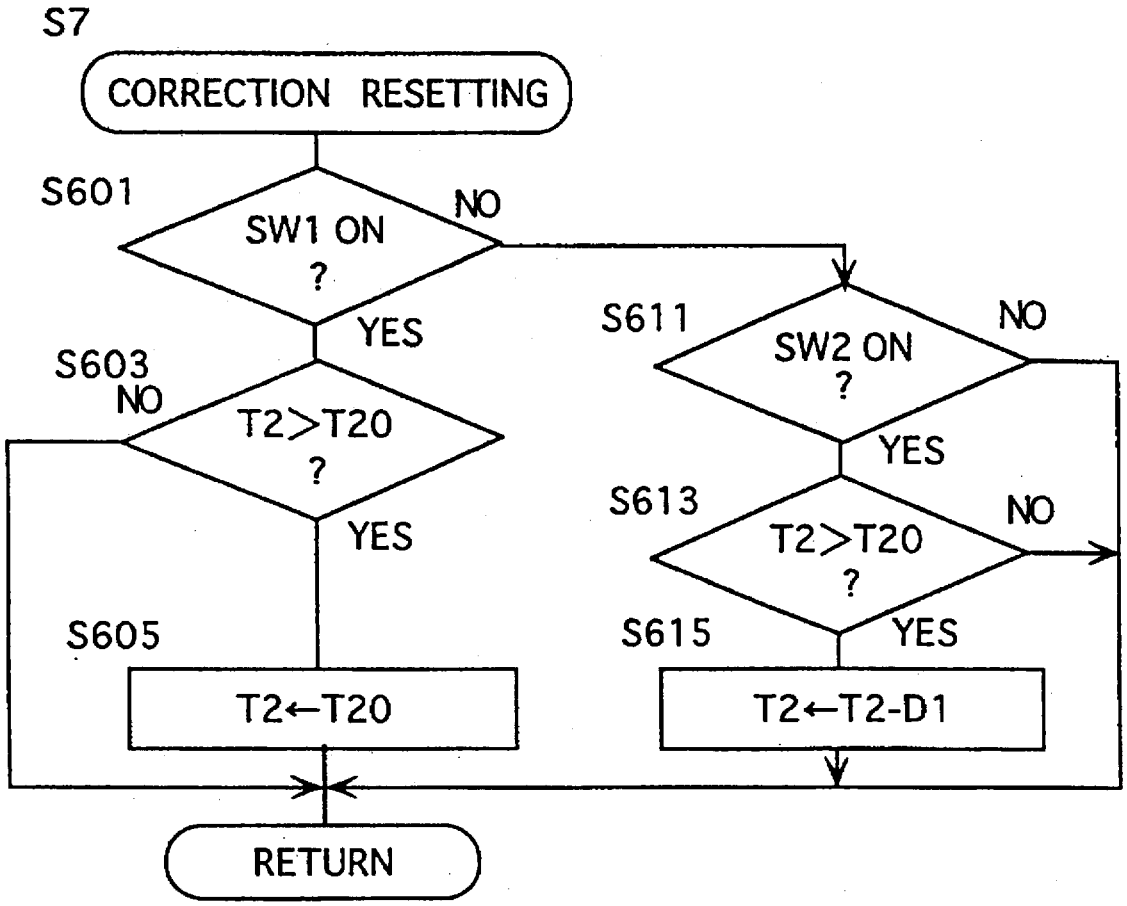
FIG. 11 is a flowchart showing a process at step S7 shown in FIG. 3.
Figure 12:
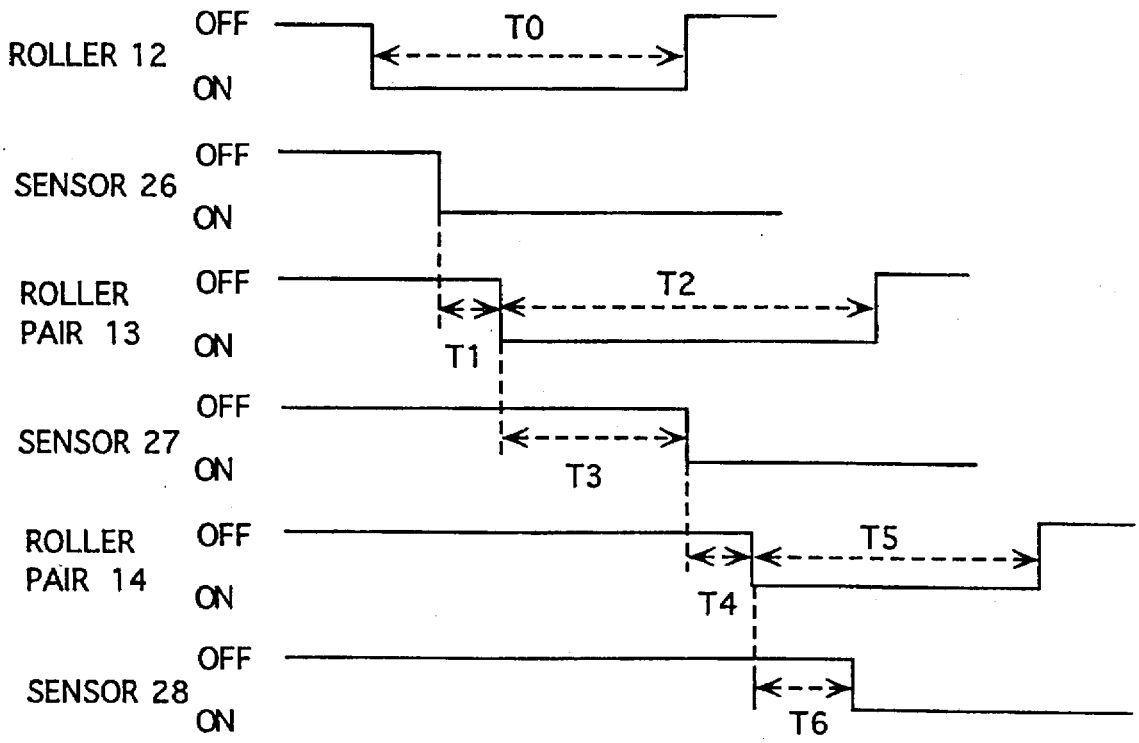
FIG. 12 is a time chart showing a relationship between timers T0–T6, rollers 12–14 and turn-on/turn-off of sensors 26–28 used for control in the first copying machine.

[2-8] Correction Resetting Process (see FIG. 11)

If a service man or the like replaces the roller(s) with new one(s) and actuates the roller replacement switch SW1 (S601: YES), it is determined whether the value of the timer T2 at this point of time is larger than the initial value T20 of the timer T2 or not. If larger (i.e., in the case where the correction was carried out) (S603: YES), the value of the timer T2 is reset to the initial value T20 (S605).

If the service man or the like actuates the correction reset switch SW2 (S611: YES), it is determined whether the value of the timer T2 at this point of time is larger than the initial value T20 of the timer T2 or not. If larger (i.e., in the case where the correction was carried out) (S613: YES), the minimum correction D1 is subtracted from the value of the timer T2, and the difference is substituted for the value of the T20 (S615).

According to the method and device for transporting the sheets described above, the time period for transporting the sheet by the upstream roller is extended in accordance with the speed difference between the sheet transport speeds of the upstream roller and the downstream roller. Such speed difference of the sheet transport may generate when the upstream roller is liable to slip due to, for example, aging and hence wear as well as adhesion of paper powder, and thereby the sheet transporting performance therefore decreases. In this case, the time period for which the upstream roller continuously transports the sheet is increased, so that the upstream roller does not stop before the leading edge of the sheet is pinched at the nip of the downstream roller pair, and thus jamming can be prevented. The extent to which the continuous transporting time period is adjusted is in accordance with the speed difference described before, so that excessive slack of the sheet does not generate between the upstream and downstream rollers, and thus disadvantages such as bending of the sheet into a Z-form can be prevented. These advantages can be achieved without complicating mechanical structures relating to the positions and number of the sensors.

Now, another practical example of the method and device for feeding the sheets according to the invention will be described below.

Figure 14:
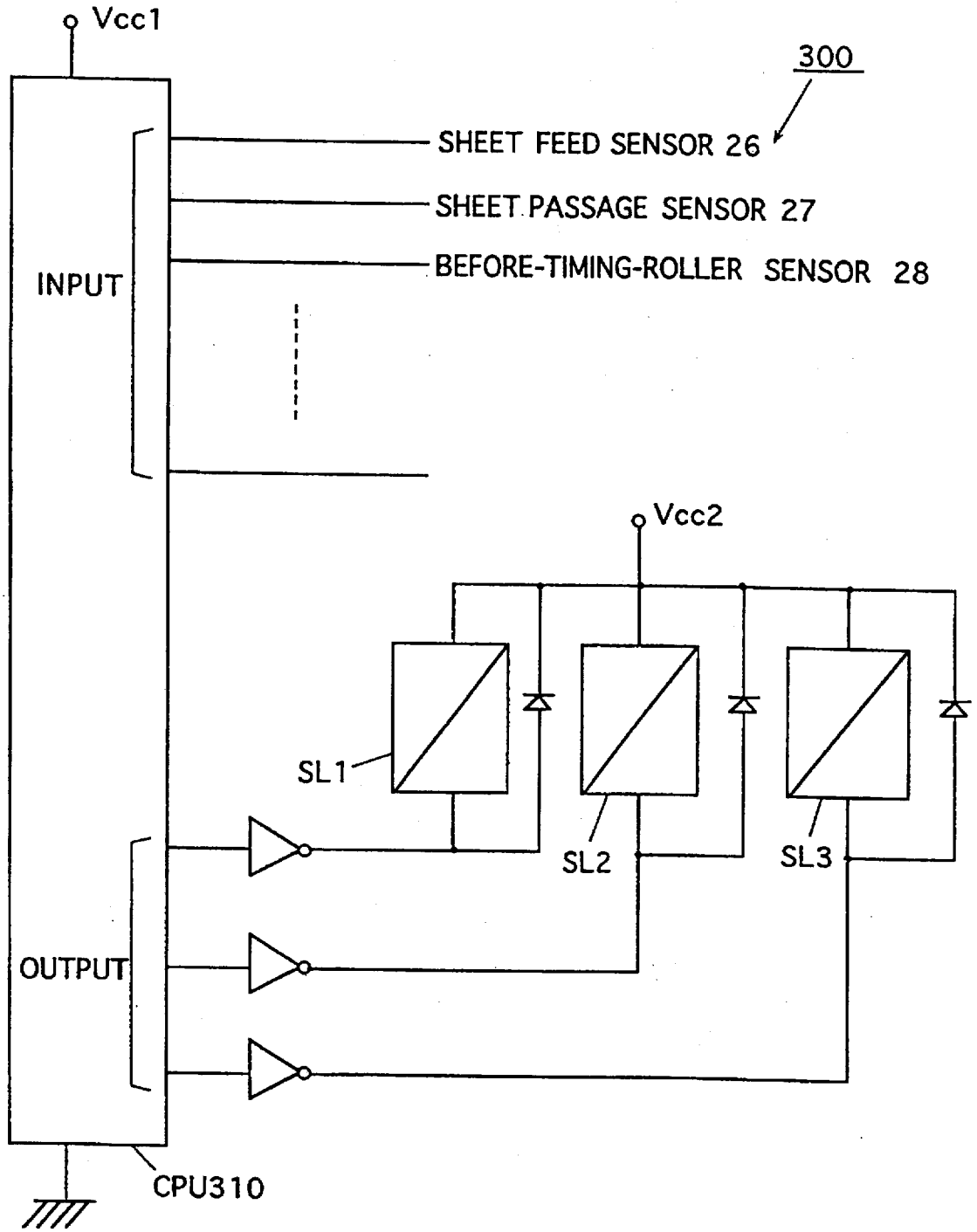
FIG. 14 is a block diagram showing a portion of a control circuitry of a second copying machine.

This sheet feeding method is implemented by a second copying machine which differs from the copying machine shown in FIG. 1 in that the controller 30 is replaced with a controller 300 shown in FIG. 14.

The sheet transporting device in the second copying machines has the substantially same mechanical structures as that in the copying machine shown in FIG. 1. The controller 300 controls the copying and sheet transporting operations in the substantially same manner as the controller in the copying machine in FIG. 1. More specifically, with respect to the sheet transportation, the feed roller 12 starts rotation in response to the turn-on of the solenoid SL1 (see FIG. 14), and thereby the sheet is drawn and sent from the sheet cassette 11 to the transporting roller pair 13. The transporting roller pair 13 starts rotation in response to the turn-on of the solenoid SL2 (see FIG. 14), so that the sheet S is fed to the intermediate roller pair 14. When the initiative in transporting the sheet changes from the roller 12 to the roller pair 13, the solenoid SL1 is turned off and the roller 12 is no longer driven. Upon turn-on of the solenoid SL3 (see FIG. 14), the roller pair 14 is rotated to send the sheet S to the timing roller pair 15. The sheet S is temporarily stopped there, and will be send to the transferring device by the roller pair 15 in synchronization with an image on the photosensitive drum 5. When the initiative in transporting the sheet changes from the roller pair 13 to the roller pair 14, the solenoid SL2 is turned off, so that the roller pair 13 is no longer driven.

FIG. 14 shows signals related to sheet transportation and sent to a central part CPU 310 of the controller 300. The central part CPU 310 likewise includes a microcomputer as a major component.

The feed sensor 26, passage sensor 27 and before-timing-roller sensor 28 send sheet detection signals to the CPU 310. Based on these input signals, the CPU 310 controls and optimizes the sheet feeding operation by controlling the turn-on and turn-off of the solenoid SL1 and others as represented in the flowcharts of FIGS. 15 to 18 and 20.

[3] SHEET CONTROL OF THE SECOND COPYING MACHINE

Then, the sheet control and others of the second copying machine will be described below in accordance with flowcharts shown in FIGS. 15 to 18 and 20 and with reference to FIG. 19.

Figure 15:
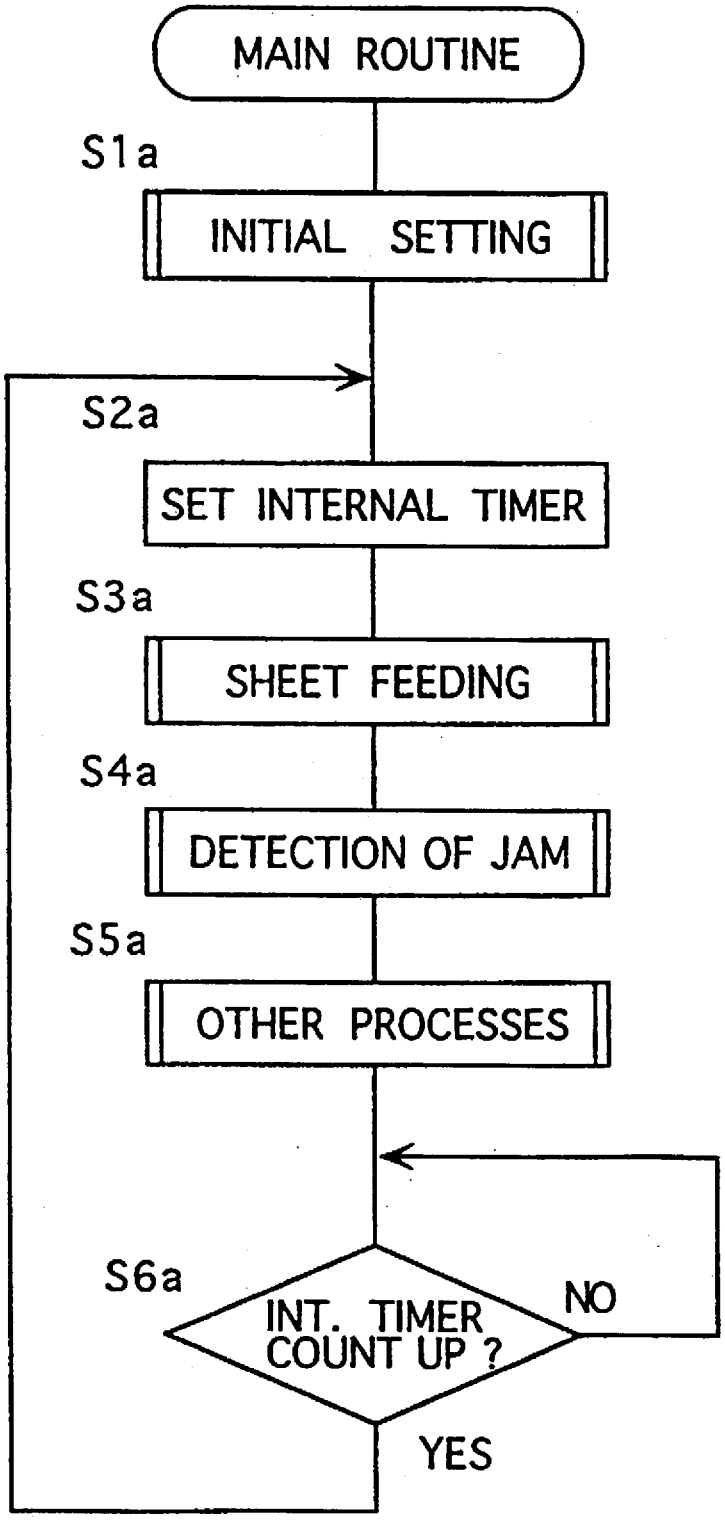
FIG. 15 is a flowchart showing a main routine of processes in a CPU 310 in FIG. 14.

[3-1] Main Routine (see FIG. 15)

The CPU 310 contains a control program shown in FIG. 15.

Upon turn-on of the power, initial setting is first carried out (S1*a*). At a subsequent step S2*a*, the internal timer for setting a cycle time of the control program is set and starts, and then, respective processes at steps S3*a*–S5*a* are repetitively carried out at every time determined by the internal timer (S6*a*). The processes at the steps S3*a* and S4*a* will be described later. The step S5*a* totally represents processes other than the processes at the steps S3*a* and S4*a* carried out by the CPU 310. The processes at the step S5*a* do not directly concern with the instant invention, and thus will not be described below.

[3-2] Description of Timers and Flags

Prior to description of the steps S3*a* and S4*a*, function of timers T1*a*, T2*a* and Tj0 and flag 1*a* used in the respective processes will be described below.

* Timer T1*a*

Figure 19:
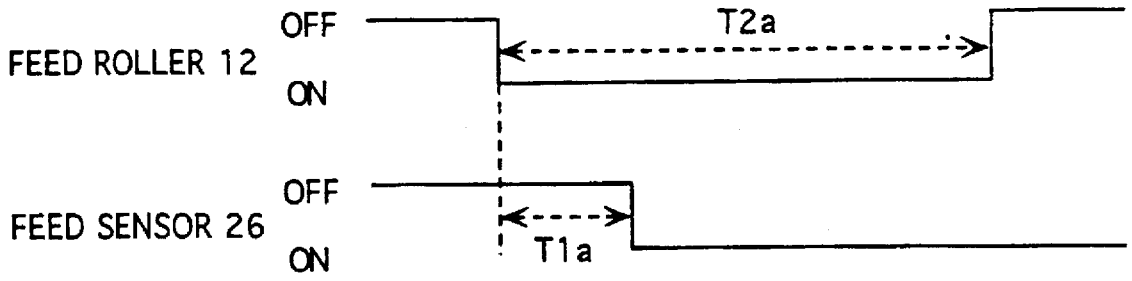
FIG. 19 is a time chart showing a relationship between timers **T1*a* and T2*a*, a feed roller 12 and turn-on/off of a sheet feed sensor 26** used for control in the second copying machine.

As shown in FIG. 19, the timer T1*a* counts the required time from the time point of turn-on of the solenoid SL1, i.e., start of rotation of the feed roller 12 to the time point at which the leading edge of the sheet is detected by the feed sensor 26. The measured value is compared with a theoretical value Tc which is a theoretical time required until the leading edge of the sheet is detected by the feed sensor 26 in the case where there is no abnormal state such as slipping of the sheet. Based on the comparison, the timers T2*a* and Tj0 are corrected as will be described later.

* Timer T2*a*

As shown in FIG. 19, the timer T2*a* controls the timing for turning off the solenoid SL1, i.e., timing for stopping the driving of the feed roller 12. At the time point of start of the feeding operation of the feed roller 12, the timer T2*a* starts decremental counting, and the solenoid SL1 is turned off to stop driving of the feed roller 12 when the value of the timer T2*a* goes to 0. The time set in the timer T2*a* is enough to allow the leading edge of the sheet fed by the feed roller 12 to be pinched at the nip of the transporting roller pair 13. A margin of, for example, about 30 mm is set.

* Timer Tj0

The timer Tj0 is provided for detecting jamming at the sheet feeding section. It starts counting from the point of time of turn-on of the solenoid SL1 (i.e., start of rotation of the feed roller 12), and is cleared when the leading edge of the sheet is detected by the sensor 27. Since the set value of the timer Tj0 is enough to allow the leading edge of the sheet to arrive at the sensor 27, it is determined that jamming occurred at the sheet feeding section when the timer Tj0 counts up without detection by the sensor 27.

* Flag 1*a*

The flag 1*a* is used for detecting the on-edge of the feed sensor 26 which corresponds to the time at which the leading edge of the sheet passes the feed sensor 26. Thus, the on-edge of the feed sensor 26 is found when the flag 1*a* is 1 and the feed sensor 26 is turned on.

Now, the respective operations and processes will be described below.

Figure 16:
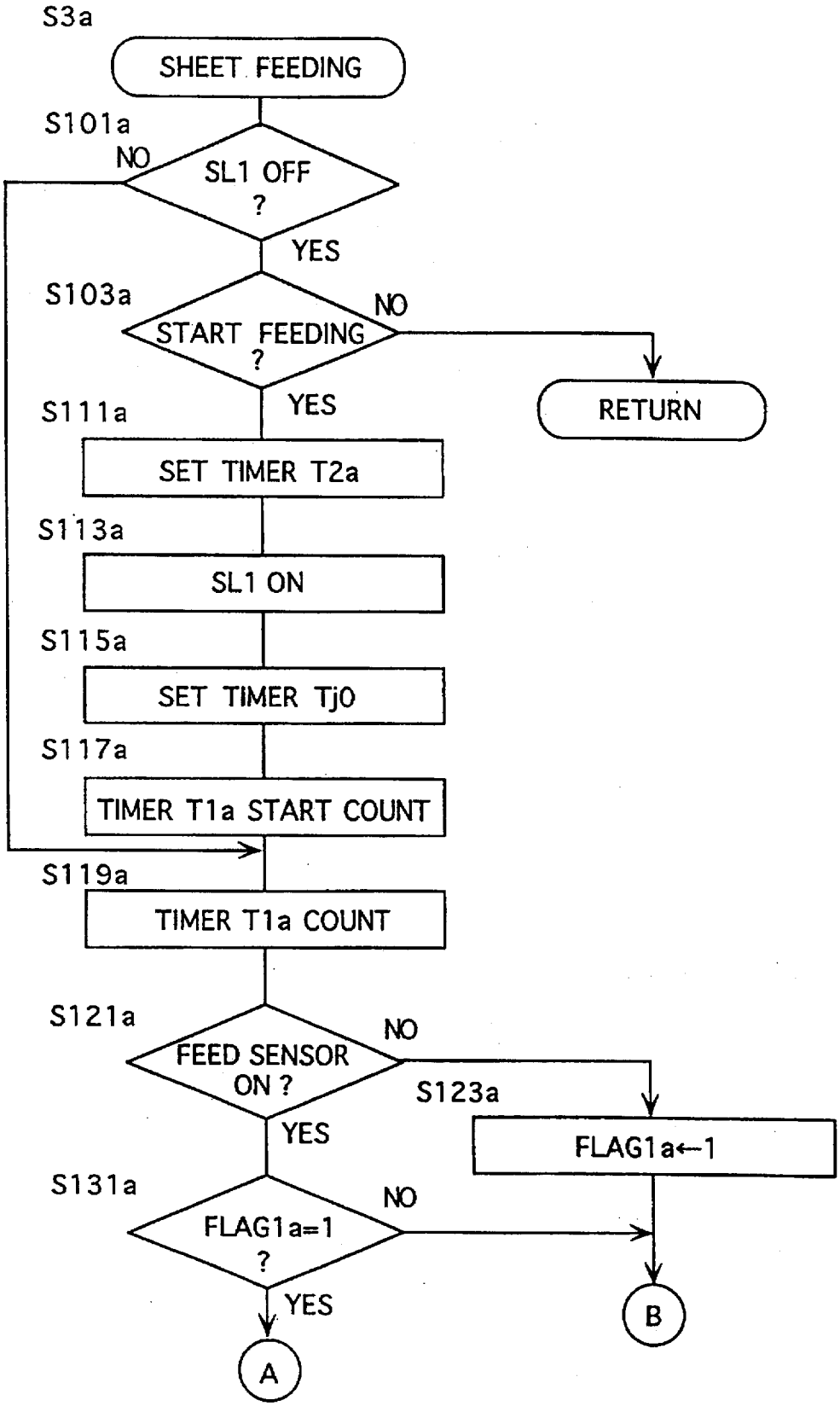
FIG. 16 is a flowchart showing a portion of a process at step **S3*a* in FIG. 15**.
Figure 17:
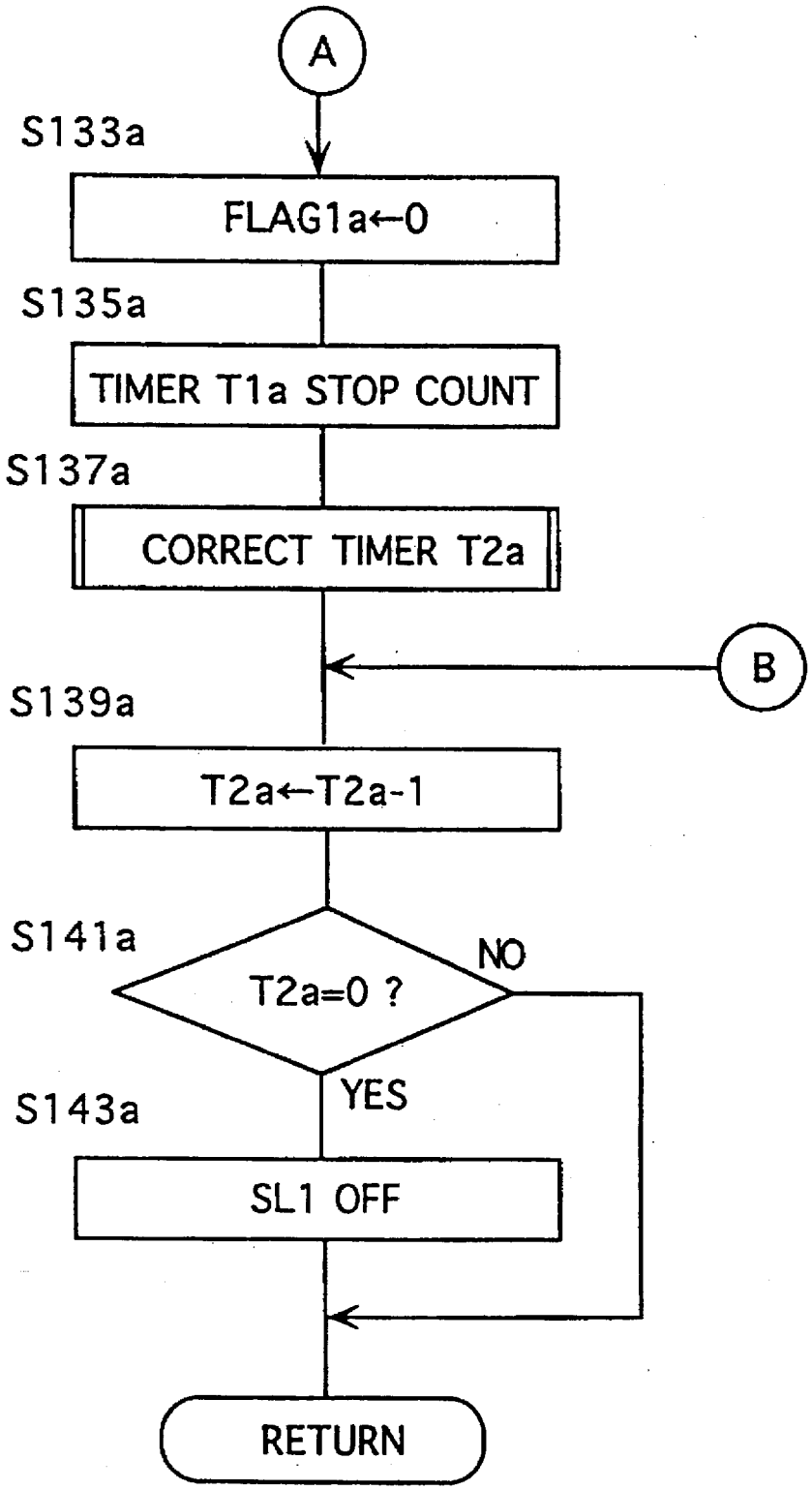
FIG. 17 is a flowchart showing a remaining portion of the process at step **S3*a* in FIG. 15**.

[3-3] Sheet Feeding Operation (see FIGS. 16 and 17.)

Rotation and stopping of the feed roller 12 are controlled.

While the solenoid SL1 is in the off state (S101*a:* YES), a copy start instruction is issued (S103*a:* YES), so that the timer T2*a* is set (S111*a*) and the solenoid SL1 is turned on (S113*a*). Thereby, the feed roller 12 starts the rotation, and the timers Tj0 and T1*a* start the counting. (S115*a*, S117*a*)

At step S119*a*, the timer T1*a* performs the counting.

The flag 1*a* is held at 1 (S123*a*) while the feed sensor 26 is in the off state (S121*a:* NO). Therefore, the state in which the feed sensor 26 is in the on state (S121*a:* YES) and the flag 1*a* is 1 (S131*a:* YES) is found when the feed sensor 26 changes its state from the off state to the on state, i.e., when the feed sensor 26 detects the leading edge of the sheet. At this timing, the timer T1*a* stops the counting (S135*a*), and the timer T2*a* is corrected (S137*a* ) as will be described later. Also, the flag 1*a* is set to 0 (S133*a*). Correction of the timer T2*a* will be described later.

At step S139*a*, the timer T2*a* performs the decremental counting.

When the timer T2*a* goes to 0 (S141*a:* YES), the solenoid SL1 is turned off (S143*a*), and the driving of the feed roller 12 is stopped.

Figure 18:
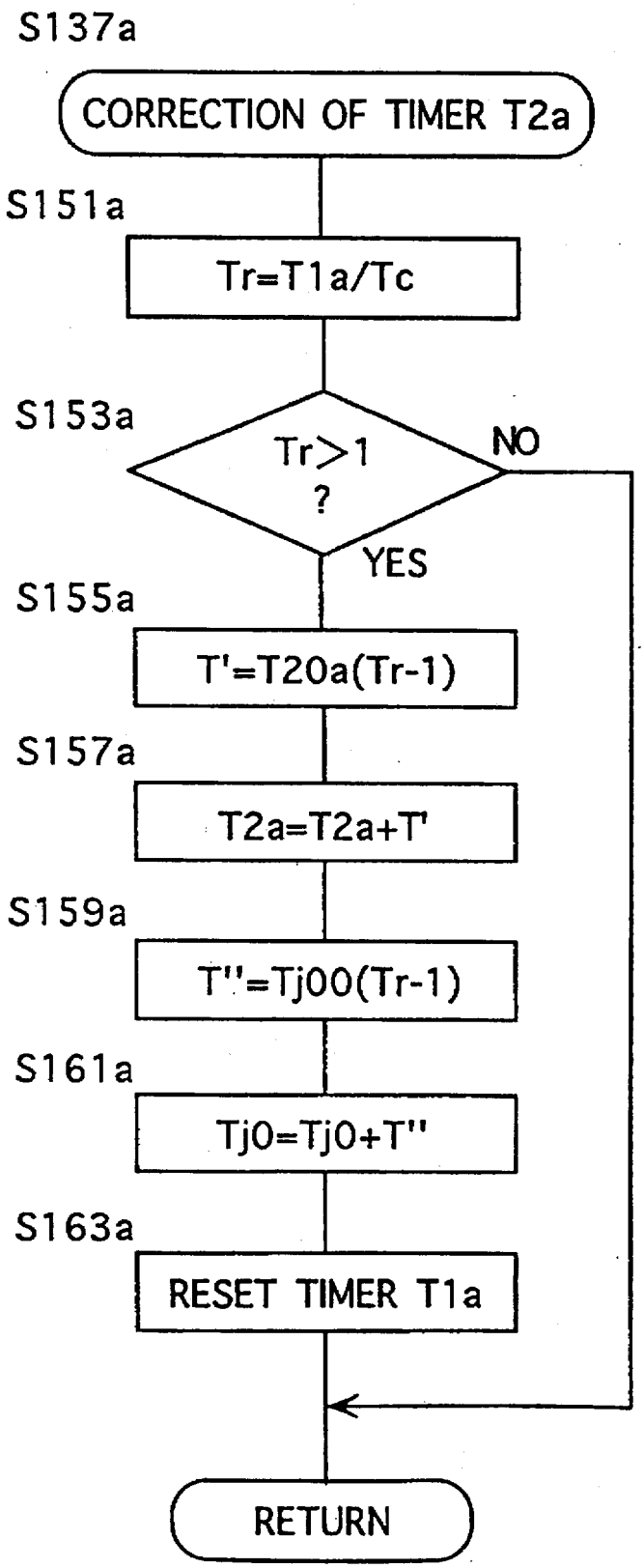
FIG. 18 is a flowchart showing a process at step **S137*a* in FIG. 17**.

[3-4] Correction of Timer T2*a* (see FIG. 18)

First, at step S151*a*, "T1*a*/Tc" is substituted for Tr. Here, Tc is a required value (i.e., a theoretical value in an ideal state) until the leading edge of the sheet being fed by the feed roller 12 arrives at and is detected by the feed sensor 26 in the case where there is no abnormal state such as slippage on the feed roller 12. T1*a* is a measured value which is measured by the timer T1*a*.

In the next step S153*a*, it is determined whether the Tr is larger than 1 or not, in other words, whether the measured value T1*a* is larger than the theoretical value Tc.

The relationship of Tr>1 (S153*a*: YES) specifically means the case where the required time until the leading edge of the sheet being fed by the feed roller 12 reaches the feed sensor 26 is longer than the theoretical value due to an abnormal state such as slippage on the feed roller 12.

If it is determined that the relationship of Tr>1 exists at step S153*a*, the timers T2*a* and Tj0 are corrected.

(Tr-1) is multiplied with the initial value T20*a* of the timer T2*a*, and the product is substituted for the correction value T' (S155*a*). Then, the correction value T' is added to the timer T2*a*, and the sum is used as a new value of the timer T2*a* (S157*a*).

Also, (Tr-1) is multiplied with the initial value Tj00 of the timer Tj0, and the product is substituted for a correction value T" (S159*a*). This correction value T" is added to the timer Tj0, and the sum is used as a new value of the timer Tj0 (S161*a*).

In this manner, the timers T2*a* and Tj0 are corrected, and then the timer T1*a* is reset (S163*a*).

Figure 20:
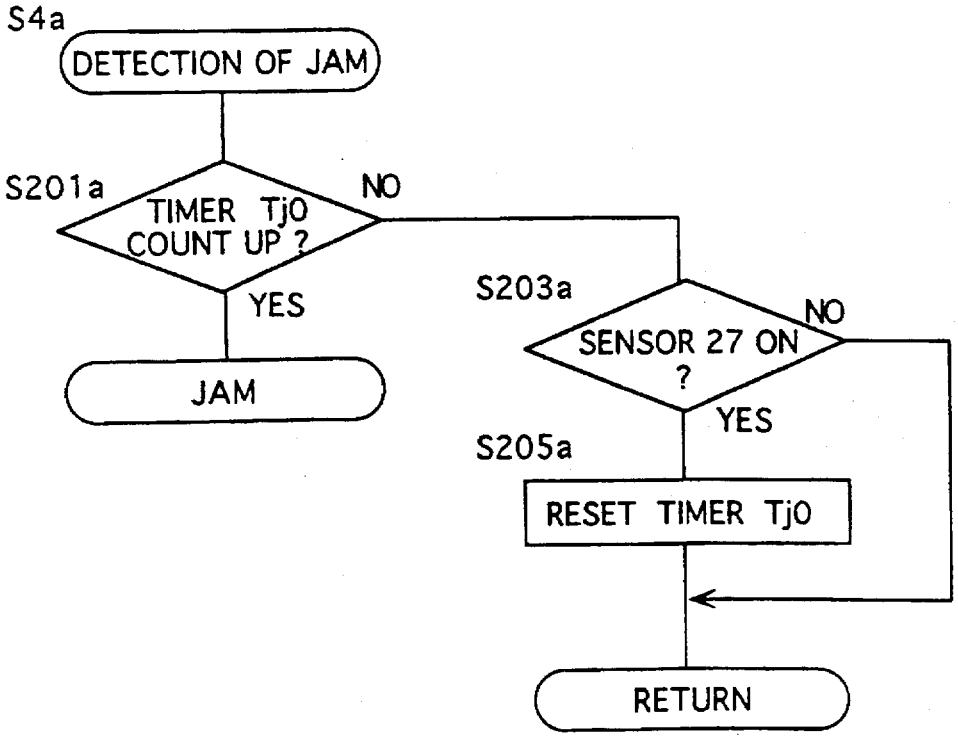
FIG. 20 is a flowchart showing a process at step **S4*a* in FIG. 15**.

[3-5] Detection of Sheet Jamming (see FIG. 20)

FIG. 20 shows jamming determination by means of the timer Tj0.

The timer Tj0 which started counting upon start of rotation of the feed roller 12 is reset (S205*a*) when the sensor 27 detects the leading edge of the sheet (S203*a*: YES).

The timer Tj0 has been set to a value large enough to allow the leading edge of the sheet fed by the feed roller 12 to reach the sensor 27 as described before. Therefore, the case (S201*a*: YES) where the timer Tj0 counts up without being reset is the case where the leading edge of the sheet has not yet reached the sensor 27 even after elapsing of the foregoing sufficiently long time. In this case, it is determined that the jamming occurs, so that a predetermined jamming process will be carried out.

Figure 21:
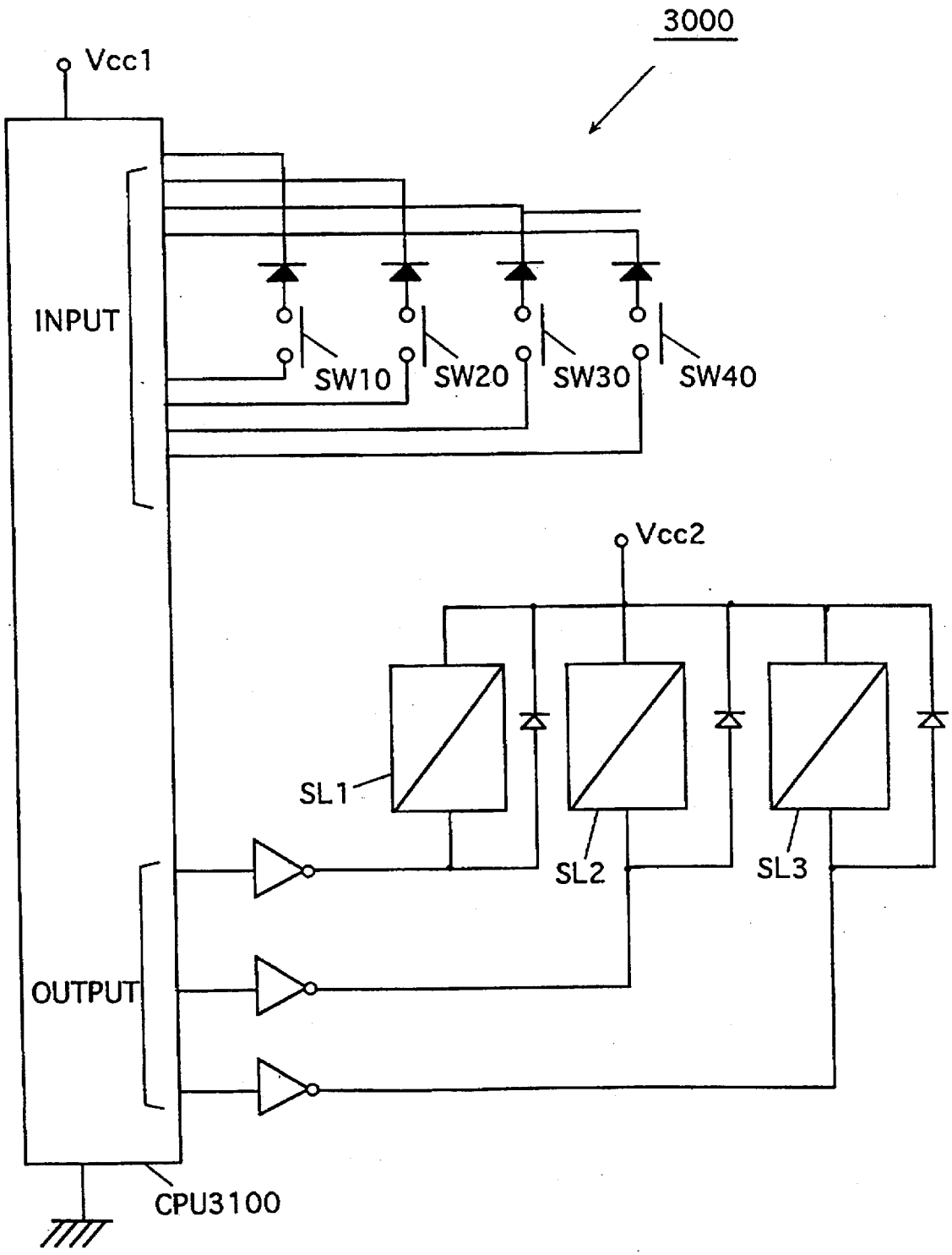
FIG. 21 is a block diagram showing a portion of a control circuitry of a third copying machine.

Still another practical example of the method and device for feeding sheets according to the invention will be described below. The sheet feeding method of this example is implemented by a third copying machine which employs a controller 3000 shown in FIG. 21 instead of the controller 30 in the copying machine shown in FIG. 1. A sheet transporting device of the copying machine has the substantially same mechanical structures as the sheet transporting device of the copying machine in FIG. 1 except for those which will be described later. Similarly to the second copying machine already described, the controller 3000 controls the basic copying and transporting operations of the copying machine in the substantially same manner as those of the sheet feeding device of the coping machine shown in FIG. 1. The controller 3000 includes a central part CPU3100 which includes a microcomputer as a major component.

[4] THIRD COPYING MACHINE

[4-1] Structures and Input/Output of Signals

The third copying machine has the substantially same structures as the first and second copying machines. It also includes a control circuitry of the substantially same structure as those of the first and second copying machines except for that signals are supplied from switches SW10–SW40 shown in FIG. 21. The switch SW10 is a contact of the feed sensor 26. The switch SW20 is a "PRINT" key, i.e., manual key switch which is provided on an operation panel 50 of the copying machine shown in FIG. 26 for instructing start of the copying operation. The switch SW30 is a correction switch which is activated, for example, by the service man who performed maintenance such as cleaning of the feed roller 12. The switch SW40 is also adapted to be actuated, for example, by the service man after replacement of the feed roller 12. In the third copying machine, the solenoid SL1 and others are controlled to be turned on and off as shown in flowcharts of FIGS. 22–25 based on input signals coming from these switches, whereby the sheet feeding operation is optimally controlled.

[4-2] Sheet Control of Third Copying Machine

Figure 27:
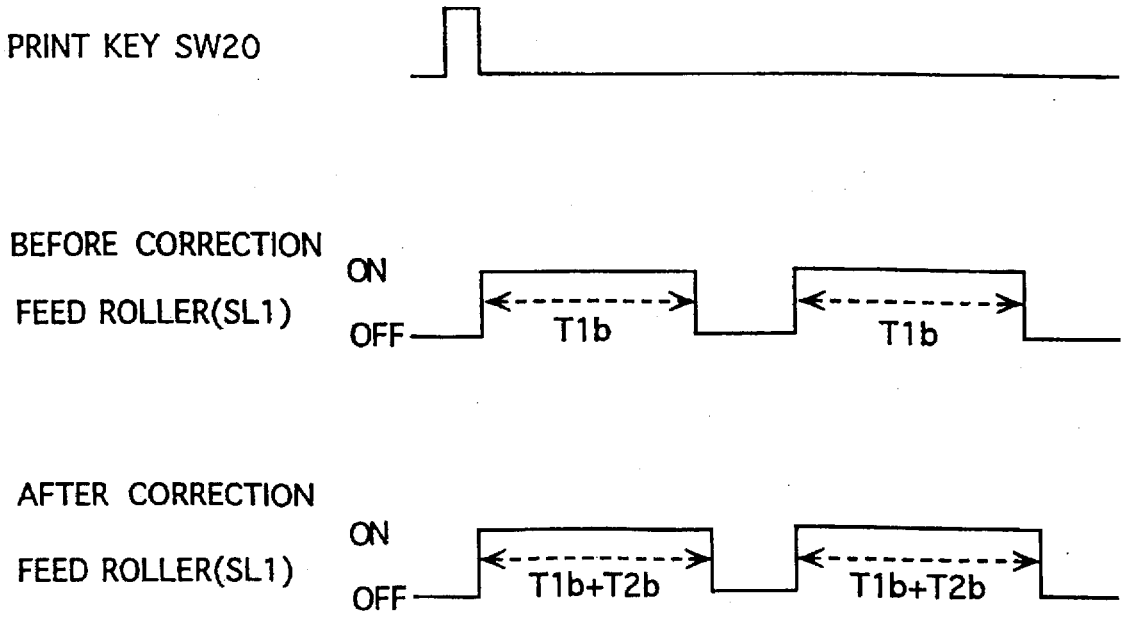
FIG. 27 is a time chart showing turn-on periods of solenoid SL1 before and after correction of a timer **T1*b*** in the third copying machine.

The sheet feed control of the third copying machine will be described below in accordance with the flowcharts shown in FIGS. 22–25 and with reference to FIG. 27.

Figure 22:
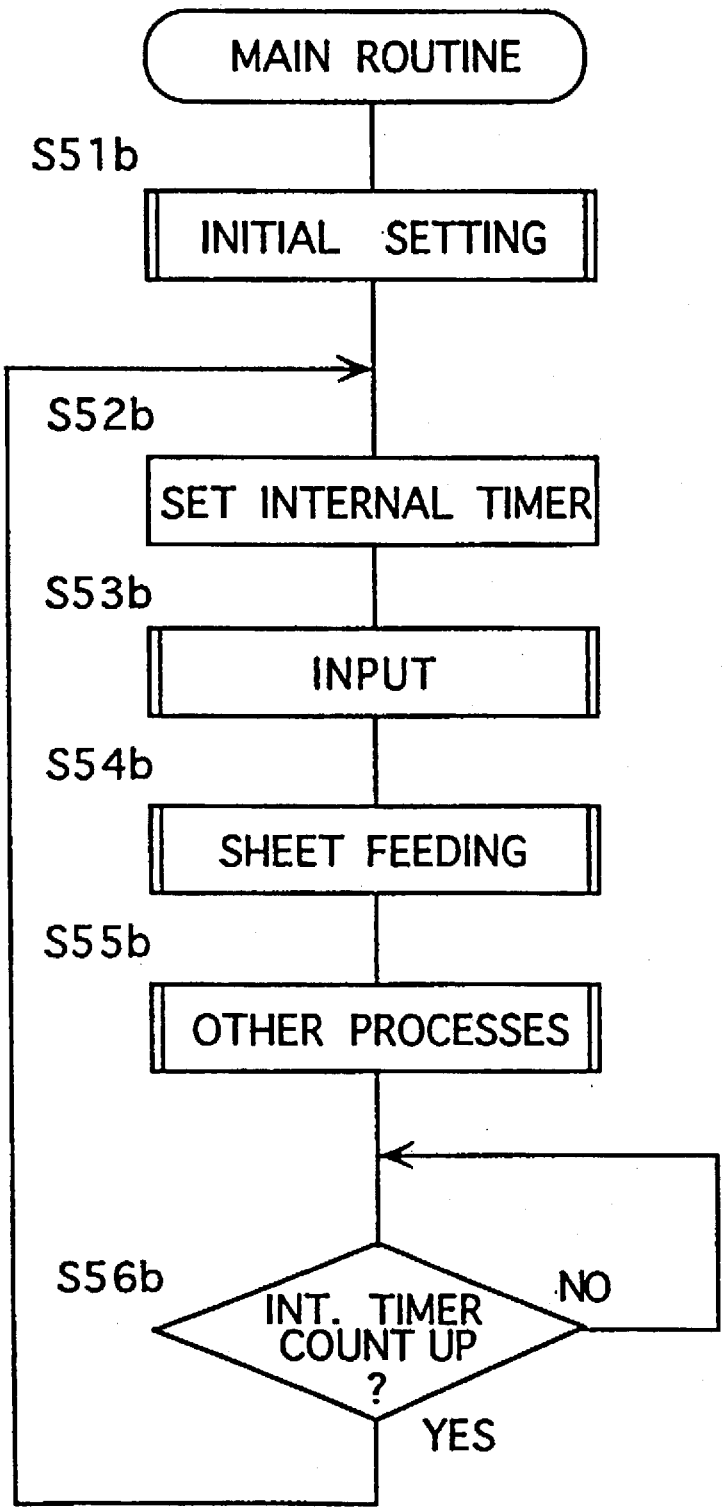
FIG. 22 is a flowchart showing a main routine of a process in CPU 3100 in FIG. 21.

[4-2-1] Main Routine (see FIG. 22)

The CPU 3100 contains a control program shown in FIG. 22.

Upon turn-on of the power, initial setting is first carried out (S51*b*). At a subsequent step S52*b*, the internal timer for setting a cycle time of the control program is set and starts, and then, respective processes at steps S53*b* to S55*b* are repetitively carried out after every elapsing of the set time of the internal timer (S56*b*). The steps 53*b* and 54*b* will be described later. The step S55*b* totally represents processes other than the processes at the steps S53*b* and S54*b* carried out by the CPU 3100. The processes at the step S55*b* do not directly concern with the instant invention, and thus will not be described below.

Figure 23:
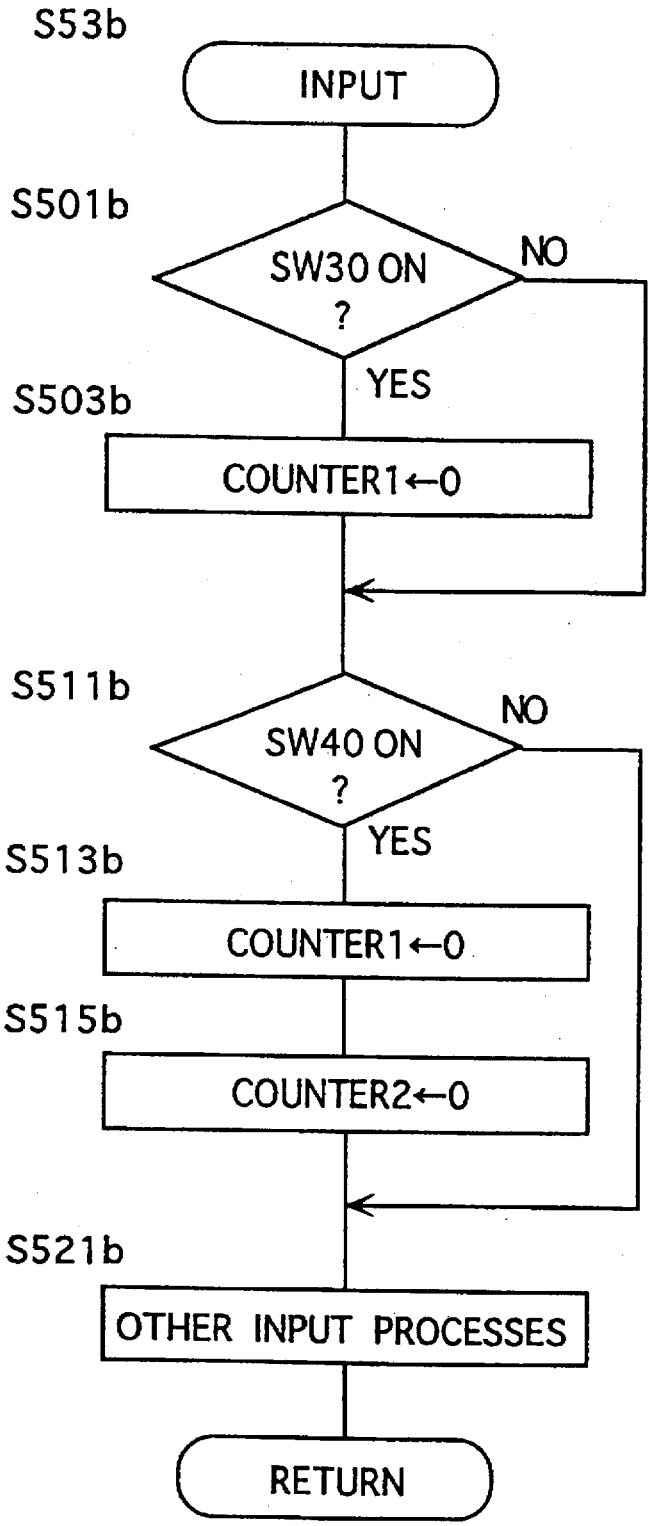
FIG. 23 is a flowchart showing a process at step **S53*b* in FIG. 22**.

[4-2-2] Input Process (see FIG. 23)

When the service man or the like carries out the maintenance such as cleaning of the feed roller 12 and actuates the correction resent switch SW30 (S501*b*: YES), the counter 1 is cleared and set to 0 (S503*b*). When the service man or the like replaces the feed roller 12 and actuates the switch SW40 (S511*b*: YES), the counters 1 and 2 are cleared and set to 0 (S513*b*, S515*b*).

A step S521*b* represents processes carried out in response to inputs other than the foregoing.

Figure 24:
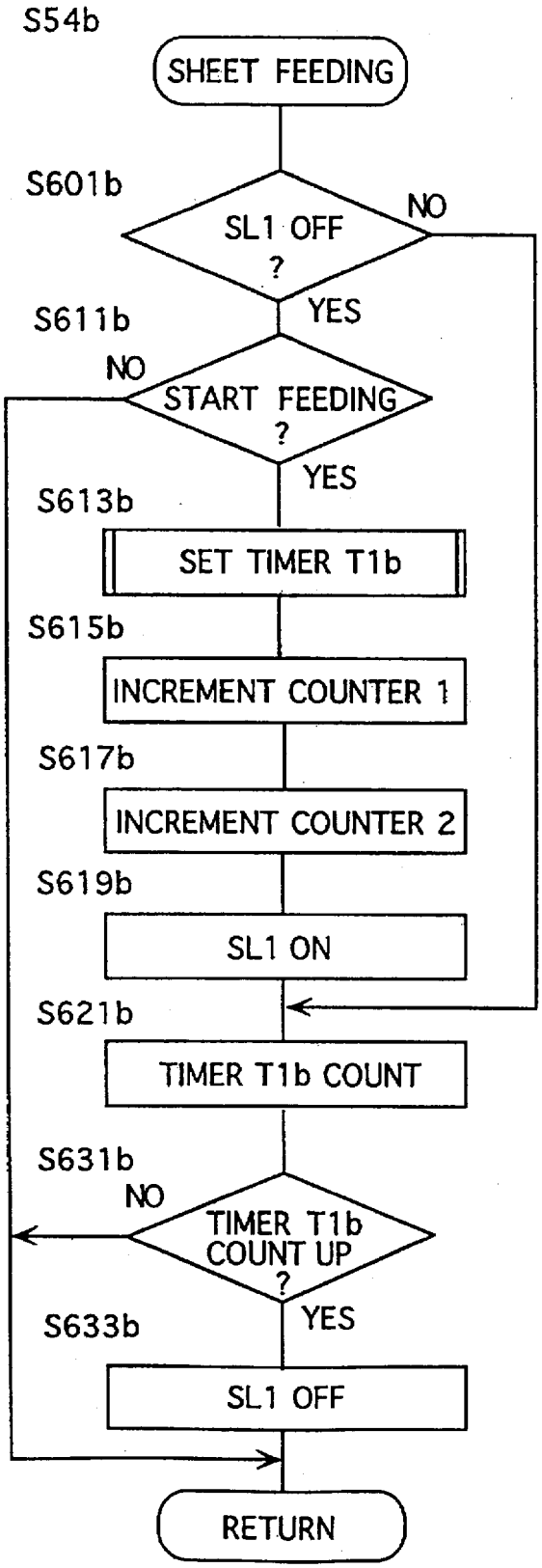
FIG. 24 is a flowchart showing a process at step **S54*b* in FIG. 22**.

[4-2-3] Sheet Feeding Process (see FIG. 24)

When the solenoid SL1 is in the off state, i.e., the feed roller 12 is not driven (S601*b*: YES), and the start of the sheet feeding is instructed for example by the actuation of the "PRINT" key SW20 (S611*b*: YES), the timer T1*b* is set (S613*b*). The value of the timer T1*b* is corrected based on the values of the counters 1 and 2 which will be described below.

The counters 1 and 2 are incremented (S615*b*, S617*b*). The counter 1 represents the total number of sheets fed after the maintenance. The counter 2 represents the number of sheets fed after the replacement of the feed roller 12.

The solenoid SL1 is turned on (S619*b*) to start rotation of the feed roller 12.

At step S621*b*, the timer T1*b* performs the counting.

When the timer T1*b* counts up thereafter (S631*b*: YES), the solenoid SL1 is turned off (S633*b*) and the driving of the feed roller 12 is stopped. Thus, the timer T1*b* controls the timing of turn-off of the solenoid SL1, i.e., timing of stop of the driving of the feed roller 12. The time set in the timer T1*b* is enough to allow the leading edge of the sheet driven by the feed roller 12 to be pinched at the nip of the transporting roller pair 13, and is corrected as follows in accordance with the values of the counters 1 and 2 by the setting process of the timer T1*b* (S613*b*).

Figure 25:
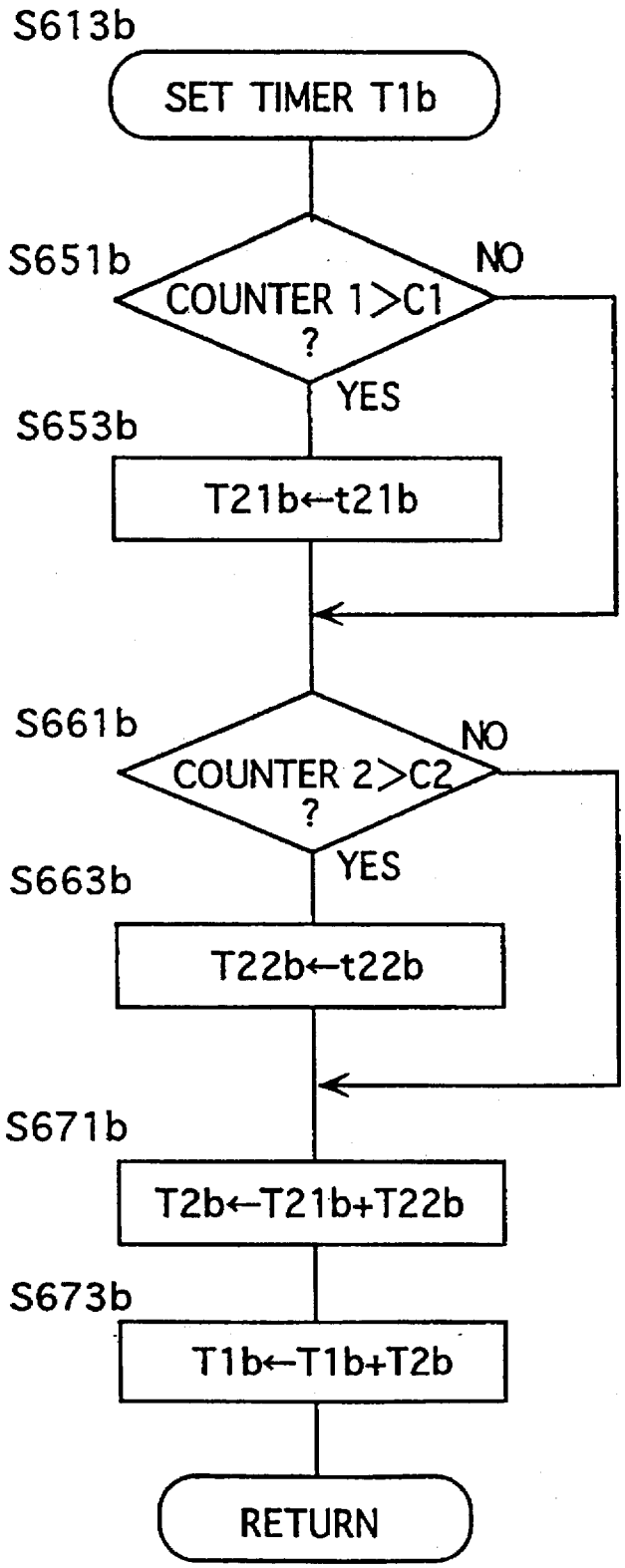
FIG. 25 is a flowchart showing a process at step **S613*b* in FIG. 24**.
Figure 26:
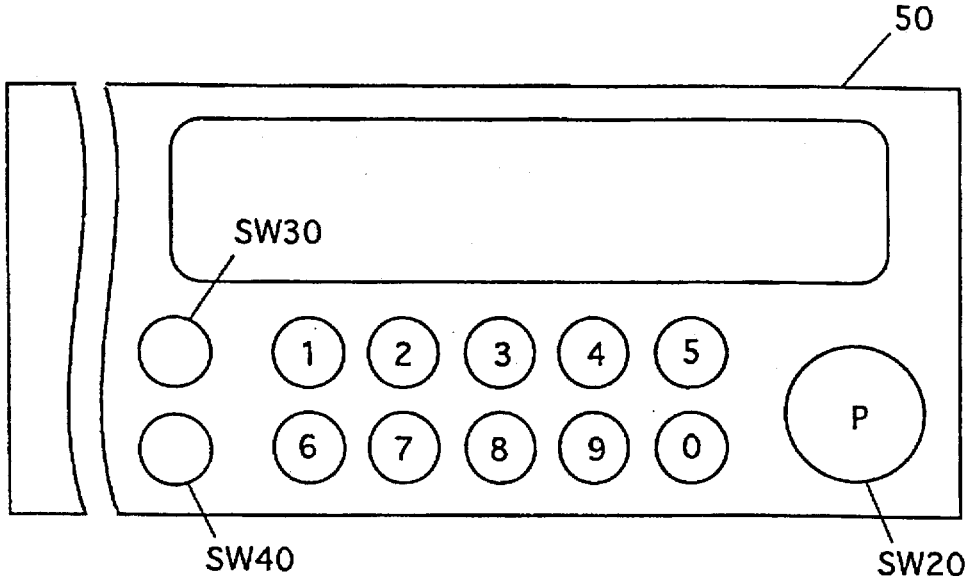
FIG. 26 shows a portion of an operation panel of the third copying machine.

[4-2-4] Setting Process of Timer T1*b* (see FIG. 25)

When the count of the counter 1 exceeds a correction reference number C1 (S651*b*: YES), t21*b* is substituted for T21*b* (S653*b*), which is a correction value for the counter 1.

When the count of the counter 2 exceeds a correction reference number C2 (S661*b*: YES), t22*b* is substituted for T22*b* (S663*b*), which is a correction value for the counter 2.

At step S671*b*, the sum (T21*b*+T22*b*) of the above values T21*b* and T22*b* is used as the total correction value T2*b* for the counters 1 and 2.

At step S673*b*, a value of the ordinary value T1*b* of the timer T1*b* plus above total correction value T2*b* is substituted for the value of the timer T1*b*.

As a result of the correction described above, the value of T1*b* before the correction changes to T1*b*+T2*b* after the correction while the solenoid SL1 is in the on state. Here, the period after the correction means the period after the fed sheet number after the maintenance exceeds C1 or after the fed sheet number exceeds C2 after replacement of the feed roller 12.

According to the method and device for transporting the sheets by the second copying machine, the time period for rotation of the roller is extended in accordance with an extent by which the travel distance of the sheet, which is transported by the rotating roller during a predetermined time, is smaller than the constant distance by which the sheet is transported when there is neither wear of the roller nor adhesion of paper powder. Therefore, the actual travel distance of the sheet transported by the roller is substantially equal to the above constant distance, so that the sheet jamming is prevented.

Further, since the above "predetermined time period" to be referred to by the jamming determining means is extended in accordance with the extent by which the travel distance of the sheet is smaller than the constant distance, the state is not determined as the "sheet jamming" if the sheet reaches the "predetermined position" within the extended time period. Thus, the state is not determined as the "sheet jamming" and the device does not stop if the transport speed due to wear or the like of the roller decreases only to an extent causing no practical impediment to the transport of sheets.

According to the method and device for transporting the sheets in the third copying machine, the time period of rotation of the roller is extended in accordance with the total number of sheets which were transported after the maintenance. Therefore, the actual transport distance of the sheet transported by the roller is substantially equal to the above constant distance regardless of conditions such as wear of the roller and adhesion of paper powder, so that the sheet jamming is prevented.

Although the invention has been described in connection with the copying machines, the invention can be applied to other image forming apparatuses such as a printer.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sheet feeding device comprising:

sheet transporting means for transporting a sheet;

control means for operating said sheet transporting means for a predetermined operating time for transporting said sheet from said sheet transporting means to a first position on a sheet transport path;

measuring means for measuring a time required for actually transporting said sheet from said sheet transporting means to a second position on said sheet transport path; and correcting means for providing a correction to said predetermined operating time based on the thus measured time, so as to transport said sheet from said sheet transporting means to said first position on said sheet transport path in the thus corrected predetermined operating time.

2. A sheet feeding device in accordance with claim 1, wherein said correcting means is operable to correct said predetermined operating time based on a comparison of said thus measured time and a predetermined reference time.

3. A sheet feeding device in accordance with claim 2, wherein said correcting means is operable to extend said predetermined operating time when said measured time is longer than said predetermined reference time.

4. A sheet feeding device in accordance with claim 3, wherein said predetermined reference time represents a theoretical time required for said sheet to travel from said sheet transporting means to said second position.

5. A sheet feeding device in accordance with claim 4, wherein said second position is located in said sheet transport path between said sheet transporting means and said first position.

6. A sheet feeding device in accordance with claim 5, wherein said measuring means measures the time, required for transporting said sheet from said sheet transporting means to said second position, while said sheet transporting means is transporting said sheet toward said first position.

7. A sheet feeding device in accordance with claim 1, wherein said correcting means is operable to correct said predetermined operating time based on a ratio of said thus measured time to a predetermined reference time.

8. A sheet feeding device in accordance with claim 7, wherein said correcting means is operable to extend said predetermined operating time, based on said ratio, when said measured time is longer than said predetermined reference time.

9. A sheet feeding device in accordance with claim 1, wherein said second position is located in said sheet transport path between said sheet transporting means and said first position.

10. A sheet feeding device comprising:

a first roller for transporting a sheet;

a second roller for transporting said sheet, said first and second rollers being located on a sheet transport path with said second roller being downstream of said first roller;

a drive device for driving said first roller;

a controller which operates said drive device for a predetermined period of time for transporting said sheet from said first roller along said sheet transport path to said second roller;

a timer which measures a time required for transporting said sheet from said, first roller to a predetermined position on said sheet transport path; and an arithmetic unit which arithmetically corrects a value of said predetermined period of time, based on the thus measured time, so as to transport said sheet from said first roller to said second roller on said sheet transport path in the thus corrected predetermined period of time.

11. A sheet feeding device in accordance with claim 10, wherein said arithmetic unit is operable to correct said value of said predetermined period of time based on a comparison of said measured time and a predetermined reference time.

12. A sheet feeding device in accordance with claim 11, wherein said arithmetic unit is operable to increase said value of said predetermined period of time when said measured time is greater than said predetermined reference time.

13. A sheet feeding device in accordance with claim 12, wherein said predetermined reference time represents a theoretical time required for said sheet to travel from said first roller to said predetermined position.

14. A sheet feeding device in accordance with claim 10, wherein said arithmetic unit is operable to correct said value of said predetermined period of time based on a ratio of said measured time to a predetermined reference time.

15. A sheet feeding device in accordance with claim 14, wherein said arithmetic unit is operable to increase said predetermined period of time when said measured time is greater than said predetermined reference time.

16. A sheet feeding device in accordance with claim 10, further comprising a tray for containing a stack of sheets, and wherein said first roller is a sheet feed roller for sequentially feeding sheets from said stack of sheets.

17. A sheet feeding device in accordance with claim 10, further comprising a sheet detection sensor for detecting an arrival of the sheet at said predetermined position, and wherein said timer starts counting in response to said drive device starting to drive said first roller and stops counting in response to said sheet detection sensor detecting the arrival of the sheet at said predetermined position.

18. A sheet feeding device in accordance with claim 10, wherein said predetermined position is located on said sheet transport path between said first roller and said second roller.

19. A method of feeding a sheet in which said sheet is in contact with a sheet transporting means, and in which said sheet transporting means is driven for a predetermined drive time period to transport said sheet from said sheet transporting means along a sheet transport path to a first position on said sheet transport path; said method comprising the steps of:

measuring during said predetermined drive time period an actual travel time required for said sheet to travel from said sheet transporting means to a second position on said sheet transport path, wherein said second position is on said sheet transport path between said sheet transporting means and said first position;

providing a correction for said predetermined drive time period based on the thus measured actual travel time; and driving said sheet transporting means for said predetermined drive time period as thus corrected by said correction to transport said sheet along said sheet transport path from said sheet transporting means to said first position.

20. A method in accordance with claim 19, wherein said step of providing a correction comprises:

comparing the thus measured actual travel time period with a predetermined travel time period; and providing a correction for said predetermined drive time period based on a difference between said measured actual travel time period and said predetermined travel time period, wherein said predetermined travel time period is representative of a theoretical period of time required for the sheet to travel from said sheet transporting means to said second position when there is no abnormality in said sheet transporting means.

* * * * *